US009677298B2

(12) United States Patent
Konduc et al.

(10) Patent No.: US 9,677,298 B2
(45) Date of Patent: Jun. 13, 2017

(54) MOBILE DRILLING RIG

(71) Applicant: Dreco Energy Services ULC, Edmonton (CA)

(72) Inventors: Kameron Wayne Konduc, Edmonton (CA); Randy Steven Stoik, Sherwood Park (CA)

(73) Assignee: Dreco Energy Services ULC, Edmonton (CA)

( * ) Notice: Subject to any disclaimer, the term of this patent is extended or adjusted under 35 U.S.C. 154(b) by 0 days.

(21) Appl. No.: 14/799,207

(22) Filed: Jul. 14, 2015

(65) Prior Publication Data

US 2016/0010323 A1 Jan. 14, 2016

Related U.S. Application Data

(60) Provisional application No. 62/024,331, filed on Jul. 14, 2014.

(51) Int. Cl.

| | |
|---|---|
| ***E21B 7/02*** | (2006.01) |
| ***E21B 15/00*** | (2006.01) |
| ***E04H 12/34*** | (2006.01) |
| ***E04H 12/18*** | (2006.01) |

(52) U.S. Cl.

CPC ..... *E04H 12/345* (2013.01); *E04H 12/187* (2013.01); *E21B 7/02* (2013.01); *E21B 15/003* (2013.01)

(58) Field of Classification Search

CPC ... E04H 12/187; E04H 12/345; E21B 15/003; E21B 7/02

USPC ..... 52/69

See application file for complete search history.

(56) References Cited

U.S. PATENT DOCUMENTS

| | | | |
|---|---|---|---|
| 295,172 | A | 3/1884 | Hill |
| 1,557,070 | A | 10/1925 | Logue |
| 2,420,803 | A | 5/1947 | Tobin |
| 2,657,017 | A | 10/1953 | Curtis |

(Continued)

FOREIGN PATENT DOCUMENTS

| | | |
|---|---|---|
| CN | 101476312 | 7/2009 |
| CN | 102536267 | 7/2012 |

(Continued)

OTHER PUBLICATIONS

International Search Report and Written Opinion for related PCT Application No. PCT/CA2015/000432 mailed Sep. 24, 2015 (9 pages).

National Oilwell Varco Elevator/Substructure/Setback Cross-Section drawing dated Jul. 24, 1979 (1 page).

National Oilwell Varco Mast & Substructure Erection Sequence drawing dated Sep. 15, 1979 (1 page).

*Blue Calypso, LLC* v. *Groupon, Inc.* (CAFC, Mar. 1, 2016) (46 pages).

(Continued)

*Primary Examiner* — Charles A Fox
*Assistant Examiner* — James Buckle, Jr.
(74) *Attorney, Agent, or Firm* — Winthrop & Weinstine, P.A.

(57) ABSTRACT

A drilling rig may include a pair of main beams supportable by a pair of rails, a substructure, an A-frame secured to the main beams, and a mast pivotably secured to the main beams and configured to lay down in a pre-erected stage. The substructure may include a plurality of pivoting legs, a drill floor having a plurality of spreaders pivotably supported by the plurality of pivoting legs, and a plurality of drill floor subassemblies supported by the plurality of spreaders. The plurality of pivoting legs supporting the spreaders may be configured to lay down in a pre-erected stage as well.

24 Claims, 25 Drawing Sheets

(56) References Cited

U.S. PATENT DOCUMENTS 2,663,375 A 12/1953 Caldwell
2,781,108 A * 2/1957 Selberg ..... E04H 12/187 52/119
3,063,509 A 11/1962 Guier
3,099,323 A 7/1963 Kelley
3,228,151 A 1/1966 Woolslayer et al.
3,271,915 A 9/1966 Woolslayer
3,327,997 A 6/1967 Zenke
3,333,377 A 8/1967 Woolslayer et al.
3,483,933 A 12/1969 Dyer
3,774,780 A 11/1973 Buffington
3,807,109 A 4/1974 Jenkins et al.
3,828,513 A 8/1974 Vanderklaauw
3,922,825 A 12/1975 Eddy et al.
3,942,593 A 3/1976 Reeve et al.
3,949,818 A * 4/1976 Russell ..... E21B 3/02 166/377
3,977,542 A 8/1976 Stolzer
4,128,229 A 12/1978 Elliston
4,135,340 A 1/1979 Cox et al.
4,269,395 A 5/1981 Newman et al.
4,290,495 A 9/1981 Elliston
4,366,650 A 1/1983 Patterson
4,375,241 A 3/1983 Gallon
4,375,892 A 3/1983 Jenkins et al.
4,421,447 A 12/1983 Gudgel
4,587,778 A 5/1986 Woolslayer et al.
4,823,870 A * 4/1989 Sorokan ..... E21B 15/003 166/79.1
4,831,795 A 5/1989 Sorokan
4,837,992 A * 6/1989 Hashimoto ..... E21B 15/003 52/118
4,885,893 A 12/1989 Wasterval, Jr. et al.
5,216,867 A 6/1993 Wasterval, Jr. et al.
5,492,436 A * 2/1996 Suksumake ..... E02B 17/00 166/366
5,954,453 A 9/1999 Thomas
6,045,297 A 4/2000 Voorheese et al.
6,141,870 A 11/2000 McDermott et al.
6,412,576 B1 7/2002 Meiners
6,634,436 B1 10/2003 Desal
6,994,171 B2 2/2006 Orr et al.
7,360,589 B2 4/2008 Moncus
7,584,809 B1 9/2009 Flud
7,765,749 B2 8/2010 Palidis
7,931,076 B2 4/2011 Ditta et al.
8,047,303 B2 11/2011 Donnally et al.
8,468,753 B2 6/2013 Donnally et al.
8,516,751 B2 8/2013 Konduc et al.
8,549,815 B2 10/2013 Donnally et al.
8,555,564 B2 10/2013 Wasterval
8,556,003 B2 10/2013 Souchek
9,091,126 B2 7/2015 Thiessen et al.
9,109,399 B2 * 8/2015 Murr ..... E21B 7/02
9,212,778 B2 12/2015 Winter
2002/0185319 A1 12/2002 Smith
2003/0102166 A1 * 6/2003 Jortveit ..... E21B 15/003 175/162
2003/0147726 A1 8/2003 Tolmon et al.
2003/0172599 A1 9/2003 Frink
2004/0211598 A1 10/2004 Palidis
2004/0240973 A1 * 12/2004 Andrews ..... E21B 7/02 414/332
2006/0180564 A1 8/2006 Keppel
2008/0257607 A1 10/2008 Winter
2009/0000218 A1 1/2009 Lee et al.
2009/0188677 A1 * 7/2009 Ditta ..... E21B 7/02 166/382
2009/0283324 A1 11/2009 Konduc et al.
2009/0321135 A1 12/2009 Vora
2010/0150660 A1 6/2010 Nadarajah et al.
2010/0303586 A1 12/2010 Hankins et al.
2011/0072737 A1 3/2011 Wasterval
2011/0114386 A1 5/2011 Souchek
2011/0280104 A1 11/2011 McClung, III
2012/0047820 A1 3/2012 Donnally et al.
2012/0138327 A1 6/2012 Sorokan et al.
2012/0201632 A1 8/2012 Yater et al.
2012/0304553 A1 12/2012 Konduc et al.
2013/0168516 A1 7/2013 Winter
2013/0180186 A1 * 7/2013 Konduc ..... E21B 15/00 52/119
2013/0269268 A1 * 10/2013 Thiessen ..... E21B 15/00 52/118
2013/0305632 A1 * 11/2013 Rivera, Sr. ..... E04H 12/345 52/117
2013/0340572 A1 * 12/2013 Flusche ..... E21B 15/00 81/57.4
2013/0340998 A1 * 12/2013 Flusche ..... E21B 7/02 166/65.1
2013/0341036 A1 * 12/2013 Flusche ..... E21B 7/02 166/379
2014/0041855 A1 * 2/2014 Rodgers ..... E21B 15/003 166/85.1
2014/0090333 A1 4/2014 Vogt
2014/0158342 A1 6/2014 Smith et al.
2014/0259985 A1 9/2014 Petrello et al.
2014/0262518 A1 9/2014 Reddy et al.
2014/0262519 A1 9/2014 Petrello et al.
2014/0262520 A1 9/2014 Petrello et al.
2014/0270974 A1 * 9/2014 Seng ..... E02B 17/021 405/201
2014/0270975 A1 * 9/2014 Seng ..... E21B 15/003 405/201
2015/0090450 A1 4/2015 Thiessen
2015/0152690 A1 6/2015 Sorokan et al.
2015/0184466 A1 7/2015 Rivera, Sr. et al.
2015/0218891 A1 * 8/2015 Padira ..... E21B 15/003 166/75.11
2016/0010323 A1 1/2016 Konduc et al.
2016/0369523 A1 12/2016 Konduc et al.

FOREIGN PATENT DOCUMENTS

RU 81516 3/2009
RU 96904 8/2010
SU 1461858 2/1989
WO 2004094762 11/2004
WO 2008114064 9/2008
WO 2009002189 12/2008
WO 2010132174 11/2010

OTHER PUBLICATIONS

Extended European Search Report for European Patent Application No. 12791970.2, mailed Sep. 2, 2015 (8 pages).
Formal Response to Written Opinion of the International Searching Authority for PCT/CA2012/000510, filed Mar. 14, 2013 (4 pages).
In re Wolfensperger, 302 F.2d 950 (CCPA 1962), dated May 18, 1962 (8 pages).
International Search Report and Written Opinion for related PCT Application No. PCT/US2014/037431, mailed Oct. 7, 2014 (17 pages).
Response to Extended European Search Report for EP 12791970.2, filed Mar. 9, 2016 (35 pages).
Written Opinion of the International Searching Authority for PCT Application No. PCT/CA2012/000510, mailed Aug. 24, 2012 (3 pages).
International Search Report and Written Opinion for related PCT Application No. PCT/CA2016/000229 mailed Oct. 26, 2016 (9 pages).
International Search Report and Written Opinion for related PCT Application No. PCT/US2016/019507 dated Dec. 21, 2016 (17 pages).

* cited by examiner

MOBILE DRILLING RIG

CROSS-REFERENCE TO RELATED APPLICATIONS

The present application claims priority to U.S. Provisional Patent Application No. 62/024,331 filed on Jul. 14, 2014, entitled Drilling Rig, the content of which is hereby incorporated by reference herein in its entirety.

FIELD OF THE INVENTION

The present application is generally directed to drilling rig assemblies. More particularly, the present application relates to a drilling rig adapted for construction on supporting rails that isolates the floor and supporting substructure from the higher capacity mast and A-frame resulting in relatively light weight assemblies maneuverable by small low lift cranes.

BACKGROUND OF THE INVENTION

In many land-based oil and gas drilling operations, drilling rigs are delivered to an oilfield drilling site by transporting the various components of the drilling rig over roads and/or highways and/or railroads. Typically, the various drilling rig components are transported to a drilling site on one or more truck/trailer combinations, rail cars, or other modes of transportation, the number of which may depend on the size, weight, and complexity of the rig. Once at the drilling site, the drilling rig components are then assembled, and the drilling rig assembly is raised to an operating position so as to perform drilling operations. After the completion of drilling operations, the drilling rig is then lowered, disassembled, loaded back onto truck/trailer combinations, rail cars, or other modes of transportation, and transported to a different oilfield drilling site for new drilling operations. Accordingly, the ease with which the various drilling rig components can be transported, assembled and disassembled, and raised and lowered can be a substantial factor in the drilling rig design, as well as the rig's overall operational capabilities and cost effectiveness.

Moreover, in particular parts of the world, access to cranes or other equipment for assembling and disassembling operations may be relatively limited and, in particular, the availability of large high lifting cranes may be limited. Where a large drilling rig with a high floor height is desired to provide for deep drill depths and high drilling capacities, the absence of large crane availability may create difficulties or impasses in assembly and disassembly of drilling rigs.

In some applications, drilling operations at a given oilfield drilling site may involve drilling a plurality of relatively closely spaced wellbores, sometimes referred to as "pad" drilling. In pad drilling, the distance between adjacent wellbores may be as little as 20-30 feet, or even less, and are oftentimes arranged in a two-dimensional grid pattern, such that rows and columns of wellbores are disposed along lines that run substantially parallel to an x-axis and a y-axis, respectively. In such pad drilling applications, after drilling operations have been completed at one wellbore, the drilling rig may be moved to an adjacent wellbore.

In light of the above, there is a need in the art for a drilling rig that can be assembled from relatively lightweight components with low heights while also providing for a rig that has a high floor height, a high capacity, and an ability to be moved for pad drilling operations.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one embodiments, relates to a drilling rig having a pair of main beams supportable by a pair of rails, a substructure, an A-frame secured to the main beams, and a mast pivotably secured to the main beams and configured to lay down in a pre-erected stage. The substructure may include a plurality of pivoting legs, a drill floor having a plurality of spreaders pivotably supported by the plurality of pivoting legs, and a plurality of drill floor subassemblies supported by the plurality of spreaders. The plurality of pivoting legs supporting the spreaders may be configured to lay down in a pre-erected stage as well. In some embodiments, the plurality of drill floor subassemblies may include an enclosure. The substructure may include a pair of base boxes in some embodiments. Further, the plurality of pivoting legs may be pivotably connected to the pair of base boxes. In some embodiments, the drilling rig may additionally include a cellar drop-in floor. In a pre-erected stage, the height of the drilling rig may be between 40-60 feet above the ground surface. In some embodiments, the A-frame may be pivotably secured to the main beams and configured to lay down in a pre-erected stage, in which case in a pre-erected stage, the height of the rig may be between 25-40 feet above the ground surface. The drilling rig may include a pair of rotary table support beams. In some embodiments, vertical loads of the mast and A-frame may be isolated from the vertical loads of the drill floor and drill floor subassemblies.

The present disclosure, in another embodiment, relates to a drilling rig having an A-frame portion, a mast portion, and a substructure portion, which may include a plurality of drill floor subassemblies and a means for pivotably erecting the subassemblies. In some embodiments, the A-frame portion and mast portion may be secured to a pair of main beams supportably by a pair of rails. The mast portion may also be pivotably secured to the pair of main beams and may be configured to lay down in a pre-erected stage. Further, the A-frame portion may also be pivotably secured to the pair of main beams and be configured to lay down in a pre-erected stage.

The present disclosure, in yet another embodiment, relates to a method for assembling drilling rig. The method may include the steps of installing a pair of main beams on a pair of rails, installing a plurality of pivoting legs in a laying down position wherein the legs are configured to pivot into an upright position, installing a drill floor pivotably supported on the pivoting legs, installing an A-frame, installing a mast in a laying down position wherein the mast is configured to pivot into an upright position, erecting the mast by pivoting it into an upright position, and erecting the drill floor by pivoting the pivoting legs into an upright position. In some embodiments, the step of erecting the mast may be completed using a drawworks. The step of erecting the drill floor may also be completed using a drawworks in some embodiments. In a laying down position, the height of the rig may be between 40-60 feet above the ground surface. In some embodiments, the A-frame may be installed in a laying down position and configured to pivot into an upright position, in which case in the laying down position, the height of the rig may be between 25-40 feet above the ground surface.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure, in some embodiments, relates to a drilling rig that can be assembled using relatively small, low capacity, and low lift cranes such as rubber tire cranes. The drilling rig may involve a series of substructures that are isolated from the larger capacity elements carrying the mast and supporting drilling loads. As such, these substructures may be relatively lightweight. In addition, the system may have a series of racking legs such that the assemblies may be set by cranes at relatively low heights and later be pulled upward and into place by pivoting the legs upward. As a result, a drilling rig with a high drill floor and a high capacity may be delivered to remote areas of the world where only low capacity low lift height cranes are available. In addition, a drilling rig of the present disclosure may also be disassembled and/or relocated using low capacity, and low lift cranes such as rubber tire cranes.

Figure 1:
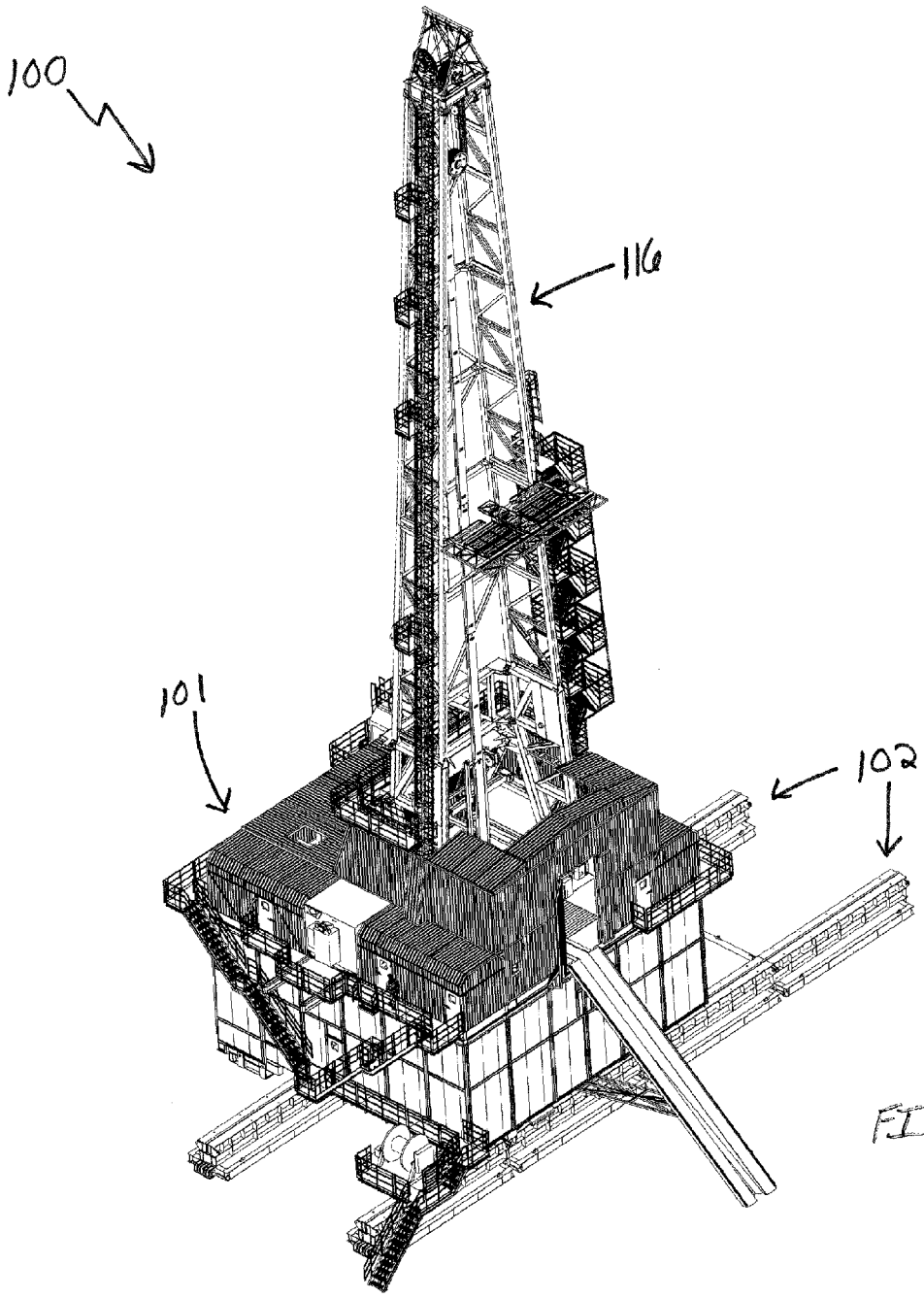
FIG. 1 is a perspective view of a drilling rig, according to some embodiments.

Referring now to FIG. 1, a drilling rig is shown. The drilling rig 100 may have a relatively high drill floor ranging from approximately 20 feet to approximately 40 feet from ground level, or a height of approximately 30'-0" or 32'-6" may be provided in other embodiments. Still other drill floor heights may be provided. As shown in FIG. 1, the drilling rig 100 may have a mast 116 that rises several feet above the drill floor. The drilling rig 100 may have a substructure 101 surrounding the mast 116 and distributing weight of the mast between a pair of rails 102.

Figure 2:
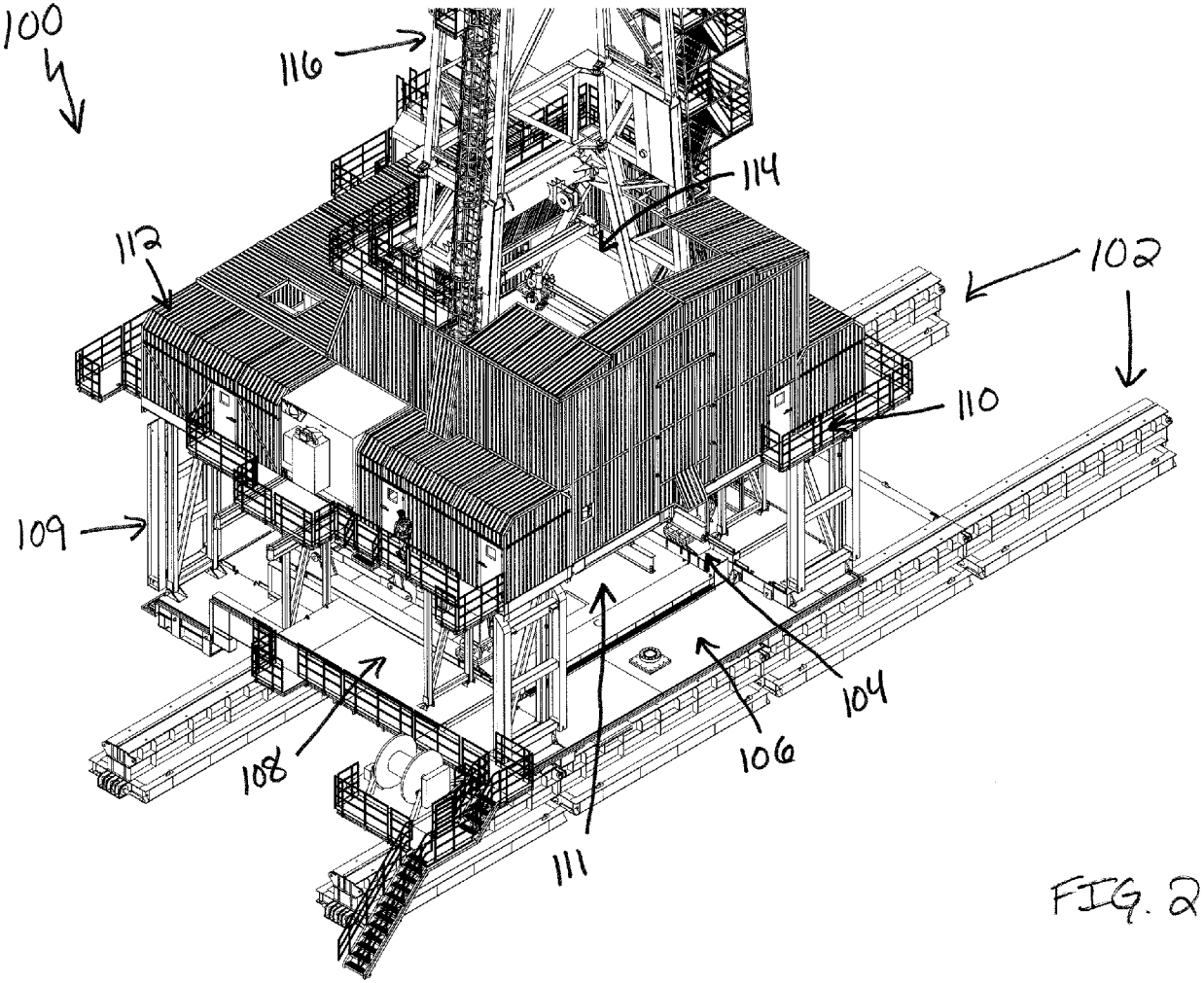
FIG. 2 is a close-up and internal view of a substructure of the drilling rig of FIG. 1.

FIG. 2 shows a more detailed and interior view of the substructure 101. As shown, the drilling rig 100 may include a pair of supporting rails 102, a pair of main support beams 104, a pair of cross spreaders 106, a pair of base boxes 108 with pivoting legs 109 for supporting a portion of the drill floor 110 and enclosures 112. The drilling rig 100 may also include an A-frame 114 and a mast 116. Below the drill floor 110, the drilling rig 100 may include a cellar drop-in floor 111. FIGS. 3-23 show a series of steps that may be performed to assemble the drilling rig.

Figure 3:
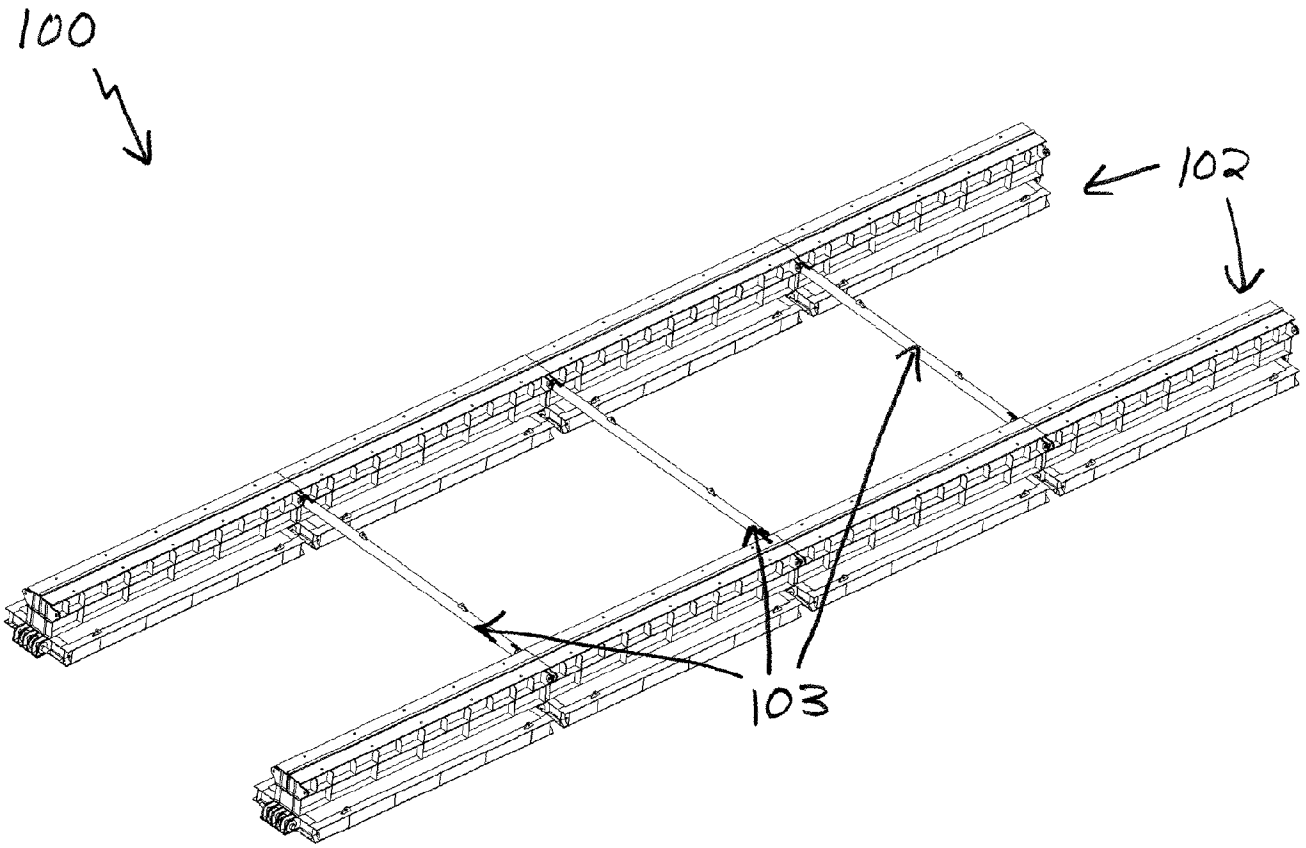
FIG. 3 is a perspective view of a pair of rails for supporting the drilling rig, according to some embodiments.

As shown in FIG. 3, a pair of supporting rails 102 may be provided. The rails 102 may be several hundred feet long and may be configured to support the drilling rig 100 and spread its load out to a bearing pressure suitable for particular soils. As shown, each rail 102 may be composed of several smaller lengths of track joined together with moment connections, for example, to achieve the desired rail length. In addition, the long length of the rails 102 may allow the drilling rig 100 to be moved along the rails 102 while stopping to drill wells along the way. The rails 102 may have a series of crossbars 103 connecting the rails at intervals, which may help in maintaining the proper distance between the rails 102 in view of shifting soils or other movement. In some embodiments, the drilling rig 100 may be assembled on walking feet, rather than rails 102. In still other embodiments, the drilling rig 100 may be assembled as a stationary unit without walking feet or rails 102.

Figure 4:
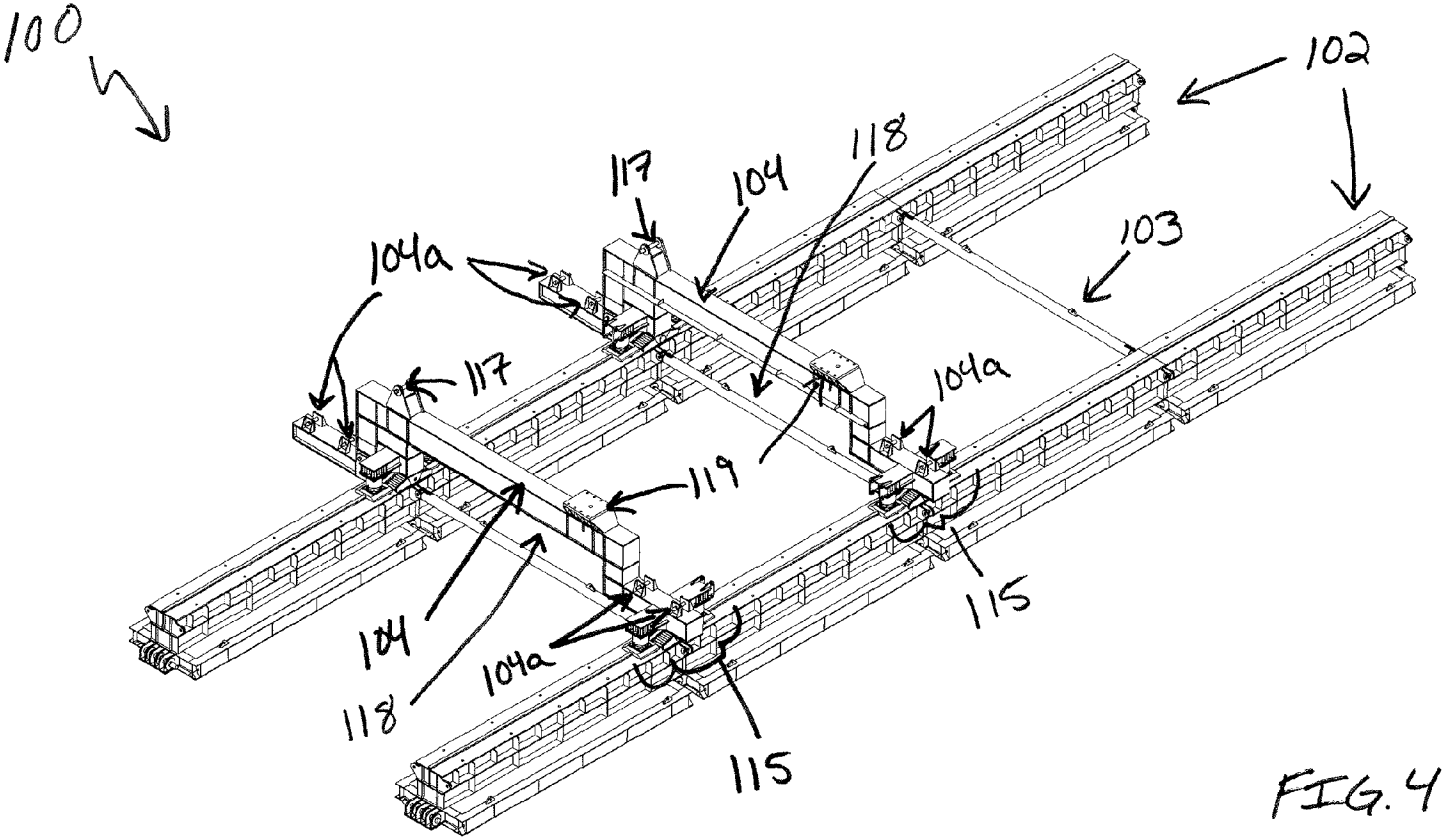
FIG. 4 is a perspective view of the rails of FIG. 3 with a pair of main beams placed thereon, according to some embodiments.

FIG. 4 shows a pair of main beams 104 arranged on the rails 102. The main beams 104 may span the distance between the supporting rails 102 and be configured and designed to support the weight of the drilling rig 100 and drilling loads. The main beams 104 may include a driller side and an off-driller side beam. The beams 104 may include mast shoes 119 for pivotably anchoring and supporting the base of the mast 116 and may also include A-frame shoes 117 for pivotably anchoring and supporting the A-frame 114. The main beams 104 may be designed to span the distance between the rails 102 while resisting the dead and live loads of the rig 100. In addition, the main beams 104 may include a set of jacks and rollers 115 at each corner where the beams rest on the rails 102 such that drilling rig 100 may be moved along the rails at selected times. Vertical jacks 115*a* may be hydraulic jacks in some embodiments that operate to lift the drilling rig 100 up off of the rollers to hold the drilling rig in a substantially stationary position. When the vertical jacks 115*a* are retracted, the rollers may contact the rails 102, allowing the rig 100 to move along the rails. The vertical jacks 115*a* may remain retracted during movement of the rig 100. After a movement is complete, the vertical jacks 115*a* may move the rig 100 off of the rollers, and back to a substantially stationary position. The main beams 104 may include one or more connectors 104*a* at each corner where cross spreaders or other structures may be installed and coupled to the main support beams. As shown, the main beams 104 may include a notch, cut out, arch, or otherwise upset portion 118. This portion 118 may be in general alignment with well center, such that when the rig is moved along the rails after completing the well, well heads, Christmas tree assemblies, blow out preventers (BOP), or other systems and devices at or around the well head may be cleared by the main beams 104. The upset portion 118 may similarly provide ground clearance when the rig 100 is installed for example on walking feet rather than rails 102. The upset portion 118 may span the distance between the rails 102 in some embodiments, or may span a shorter distance between the rails in other embodiments. In some embodiments, the bottom of the upset portion 118 together with the depth of the rails 102 may provide from approximately 8 feet to approximately 15 feet, or without rails from approximately 4 feet to approximately 11 feet of clearance above the ground.

Figure 5:
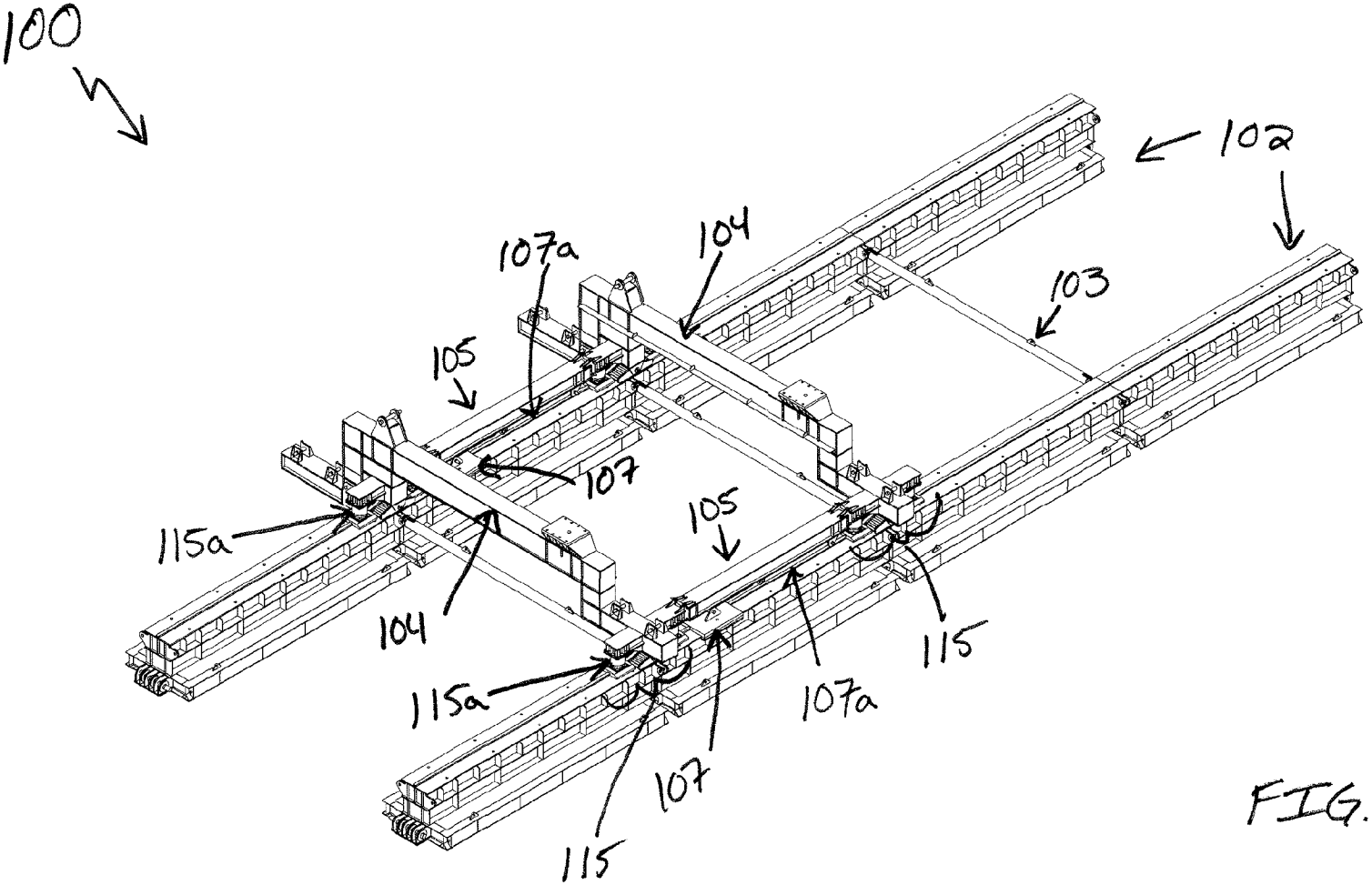
FIG. 5 is a perspective view of the elements of FIG. 4 in addition to a pair of beam spreaders extending between the main beams, according to some embodiments.

FIG. 5 shows a pair of main support beam spreaders 105 arranged on generally outboard portions of the main beams 104. The beam spreaders 105 may be designed to tie the main beams 104 together and may be configured and designed generally to support the drill floor 110 in substantial isolation from the main lifting and mast loads of the drilling rig 100. The beam spreaders 105 may generally aid stabilization of the drill floor 110 while the rig 100 is stationary at a drilling location. The main support beam spreaders 105 may each have a rail foot 107 that may facilitate movement of the drilling rig 100 along the rails 102. When the drilling rig 100 is moved on the rails 102 using the jack and roller systems 115, the rail feet 107 may remain coupled to the rails in some embodiments. During movement of the rig 100, horizontal jack cylinders 107*a* may facilitate movement of the rail feet 107 along the rails 102. With the rail feet 107 coupled to the rails 102, horizontal jack cylinders 107*a* may push the rig 100 along the rails, facilitating movements along the rollers of the jack and roller systems 115.

Figure 6:
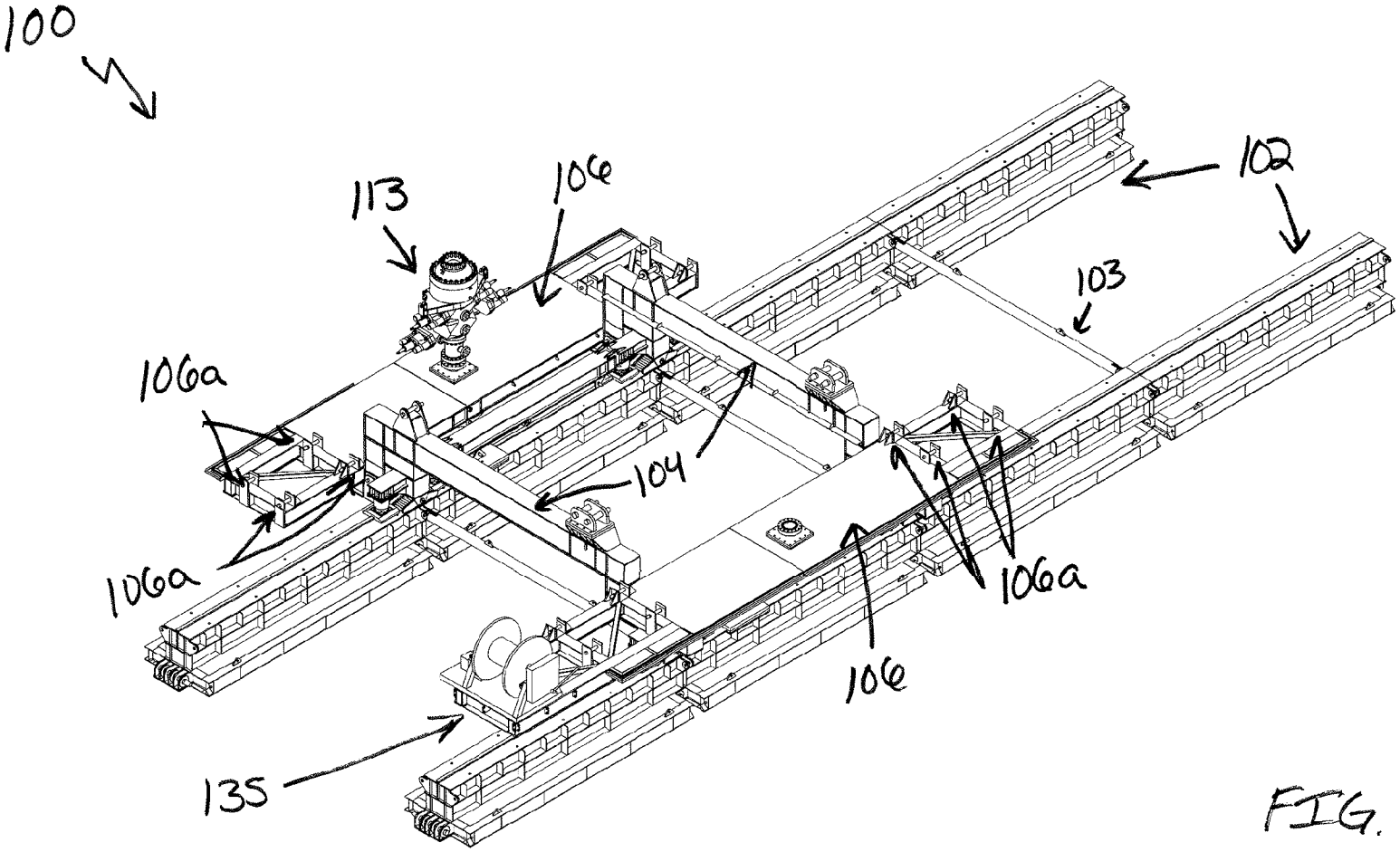
FIG. 6 is a perspective view of the elements of FIG. 5 in addition to a pair of cross spreaders extending between the main beams, according to some embodiments.

FIG. 6 shows a pair of main support cross spreaders 106 arranged on generally outboard portions of the main beams 104. The cross spreaders 106 may be designed to tie the main beams together and may be configured and designed generally to support the drill floor 110 in substantial isolation from the main lifting and mast loads of the drilling rig 100. The cross spreaders 106 may be generally designed to support a plurality of subassemblies and to distribute weight between the outboard portions of the main beams 104. As shown, the cross spreaders 106 may provide a flat surface for working and handling equipment below the drill floor 110. In other embodiments, the cross spreaders 106 may be generally open frames that may be low slung between the main beams 104 providing for more clearance below the drill floor 110 for moving and handling BOP's, Christmas tree assemblies and the like. The spreaders 105, 106 may be brought in with a flatbed truck trailer and dropped onto the main beams 104 and pinned to the connectors 104*a* at each corner, for example. As shown, a BOP 113 may be placed on one of the cross spreaders 106, so that it may be ready for installation on the well head at the beginning of drilling operations. A Christmas Tree may be assembled on the spreader 106 during drilling operations as well. A wireline spooler 135 to accommodate drilling line may additionally be placed on at least one of the cross spreaders 106. In some embodiments, the cross spreaders 106 may include one or more connectors 106*a* at each corner where base boxes or other structures may be coupled to the cross spreaders.

Figure 7:
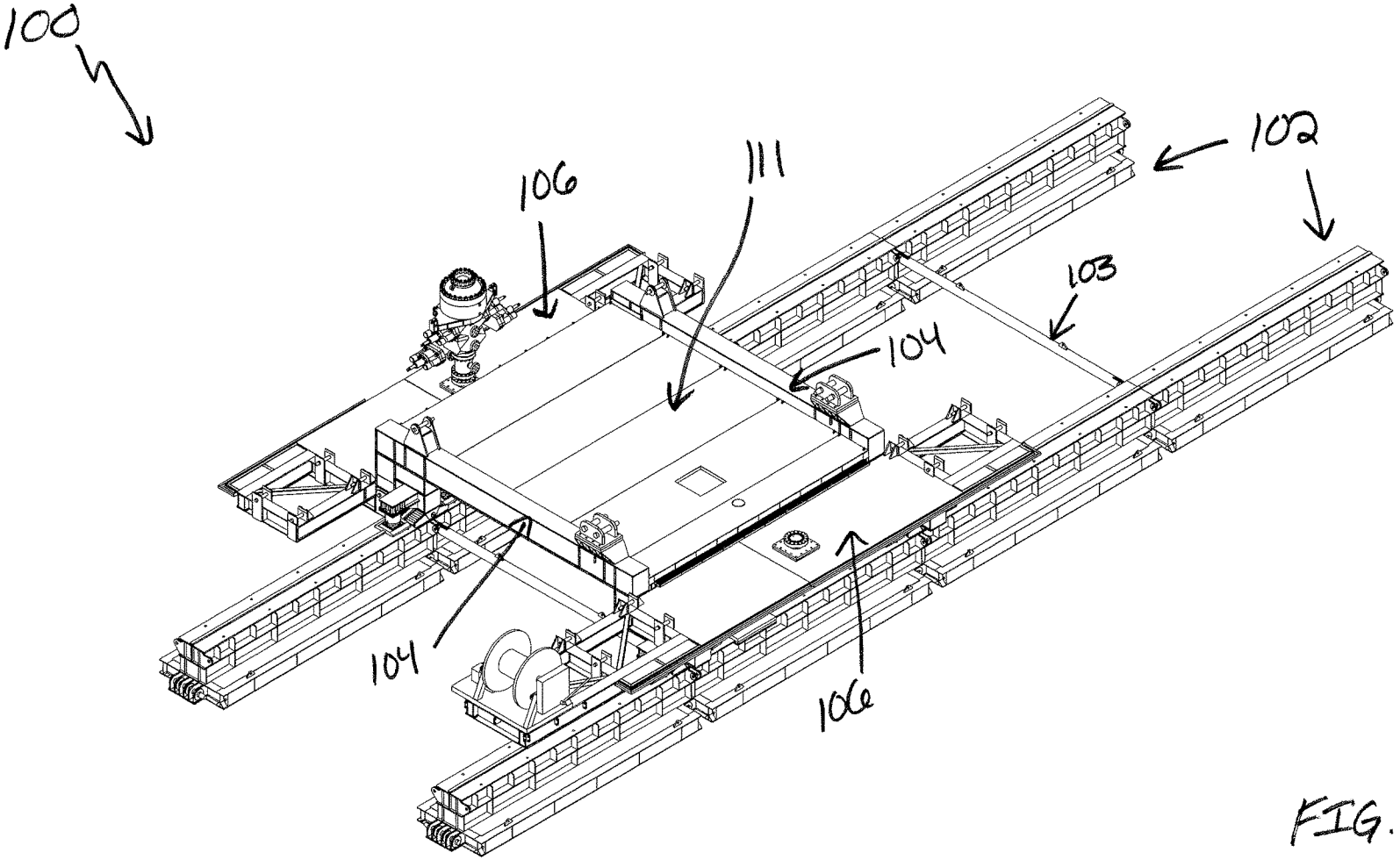
FIG. 7 is a perspective view of the elements of FIG. 6 in addition to a cellar drop-in floor between the cross spreaders, according to some embodiments.

FIG. 7 shows a cellar drop-in floor 111. The cellar drop-in floor 111 may generally span in one direction the length between the two cross spreaders 106, and in an orthogonal direction the length between the two main beams 104. The cellar drop-in floor 111 may consist of one or more components, assembled in place or prior to installation. The cellar drop-in floor 111 may enclose a cellar portion of the substructure 101 from the open ground below. This may be particularly important in cold climates for example. If the cellar portion is heated, exposure of the heat to the ground surface may cause permafrost to melt, which may in turn lead to shifting or sinking beneath the drilling rig 100. The cellar drop-in floor 111 may provide an insulative barrier between the heated cellar portion and the frozen ground in these and similar situations. Still further, the cellar drop-in floor 111 may provide for a clear working surface below the drill floor 110.

Figure 8:
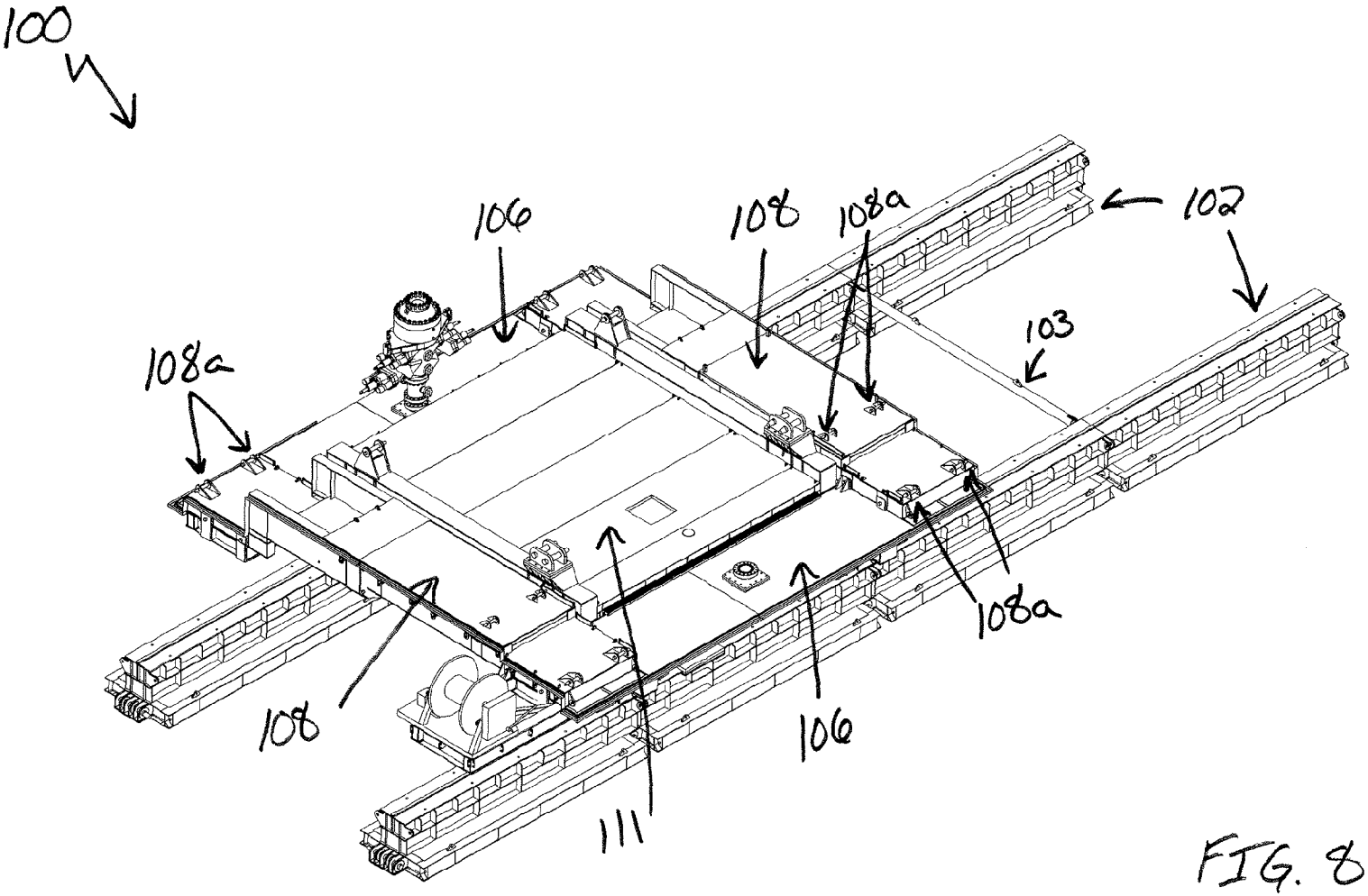
FIG. 8 is a perspective view of the elements of FIG. 7 in addition to a pair of base boxes extending between the cross spreaders, according to some embodiments.

FIG. 8 shows a pair of base boxes 108. The base boxes 108 may extend between the cross spreaders, and may generally be designed to support the enclosures 112, other subassemblies, and/or at least a portion of the drill floor 110. The base boxes 108 may connect to the cross spreaders 106 at the connectors 106*a* at each corner of the cross spreaders using pins for example. Each base box 108 may include one or more connectors 108*a* where pivoting legs 109 or other structures may be pivotably coupled to the base box.

Figure 9:
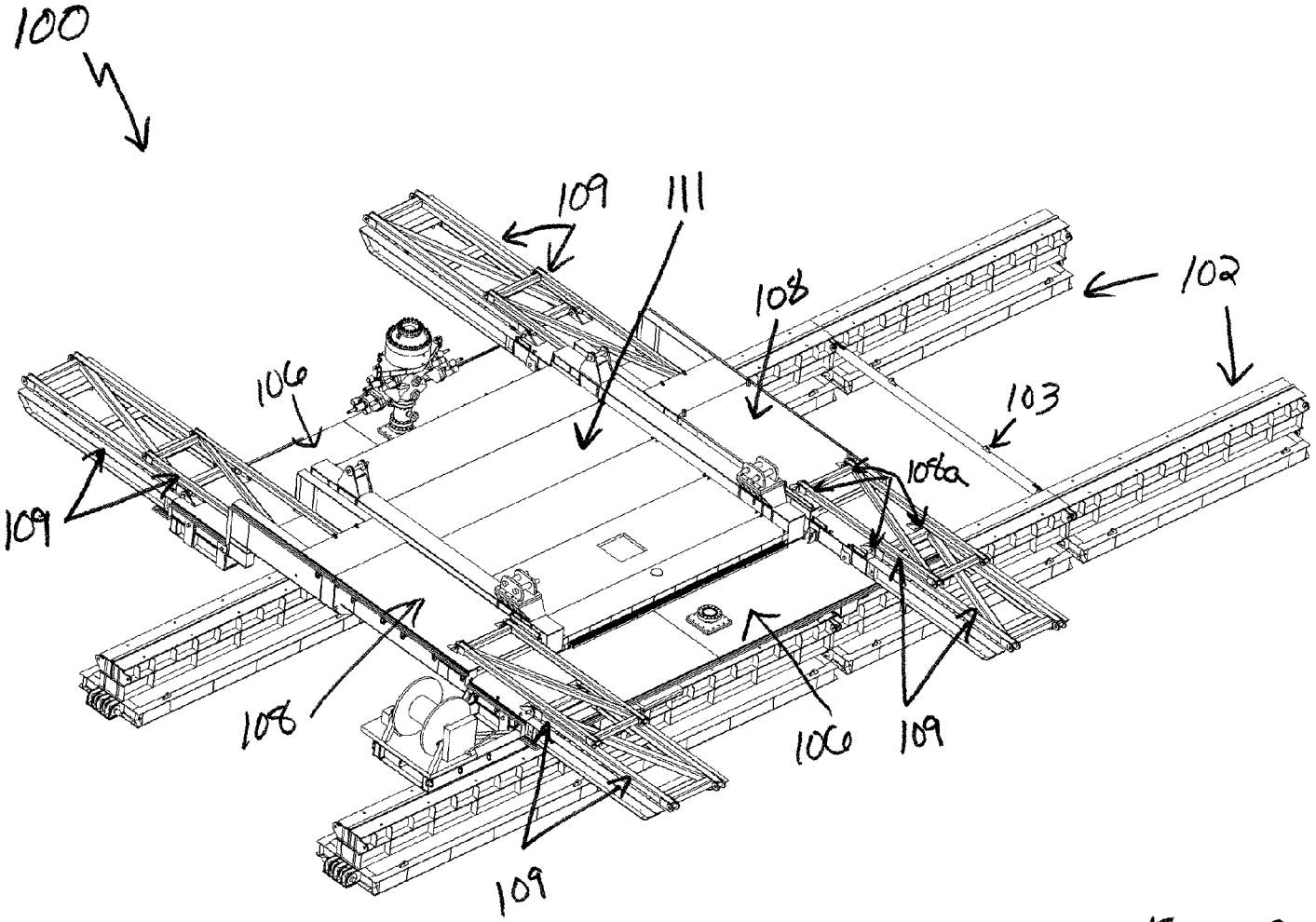
FIG. 9 is a perspective view of the elements of FIG. 8 in addition to four sets of pivoting legs on the base boxes, according to some embodiments.

For example, FIG. 9 shows a set of pivoting legs 109 attached using the connectors 108*a* at each end of the two base boxes 108. In other embodiments, any number of legs or sets of legs may be attached to the base boxes 108. As shown in FIG. 9, the legs 109 may be collapsed against the base boxes 108 in pivoting or racked fashion. In this way, the drill floor 110 and subassemblies may be constructed on the racked legs 109 at a relatively low height, using for example a low lift crane, while allowing for later upward motion to raise the drill floor and subassemblies upward. Thus, there may be a pivoting connection between the legs 109 and the drill floor 110, similar to the pivoting connection between the legs and the base boxes 108. The legs 109 may be designed to support enclosures 112, other subassemblies, and/or at least a portion of the drill floor 110. In some embodiments, the legs 109 may be isolated from the mast 116 and A-frame 114 loads as shown, so as to isolate the weight of the drill floor 110 and subassemblies from the weight of the mast and A-frame.

As may be appreciated, the drill floor 110, which is supported by the pivoting legs 109, may be assembled in multiple portions, such as for example a drawworks portion 110*a* and a setback portion 110*b*. In other embodiments, the drill floor 110 may be divided into any number of portions. The portions 110*a*, 110*b* may remain separate until they are raised upward on the pivoting legs 109 and joined together. For this reasons, the pivoting legs 109 may be attached to the base boxes 108 so as to pivot in different directions. For example, the legs 109 supporting the drawworks side 110*a* may pivot in an opposite direction from the legs supporting the setback side 110*b*, such that both sides pivot inward toward the mast 116 or well center.

Figure 10:
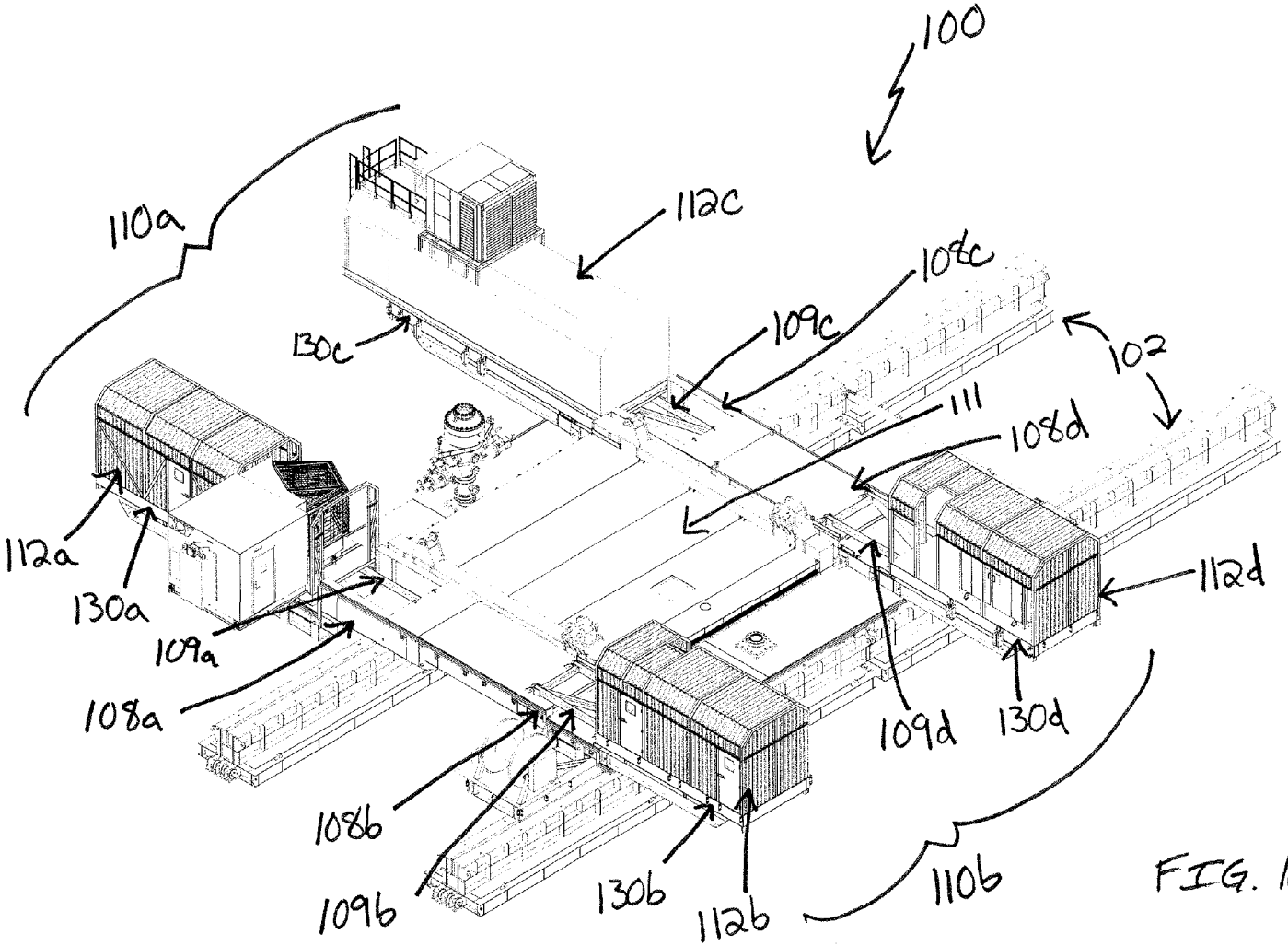
FIG. 10 is a perspective view of the elements of FIG. 9 in addition to drill floor subassemblies including enclosures, according to some embodiments.

FIG. 10 shows enclosures 112 and upper floor portions 130 attached to the collapsed or racked legs 109. Upper floor portions 130 may form a portion of the drill floor 110 in some embodiments. In some embodiments, the base boxes 108, legs 109, upper floor portions 130, and enclosures 112 may be shipped and delivered to the project site as four subassemblies, for example. Each subassembly may include, for example, a pair of legs 109*a*, 109*b*, 109*c*, 109*d*, at least a portion of a base box 108*a*, 108*b*, 108*c*, 108*d*, an upper floor portion 130*a*, 130*b*, 130*c*, 130*d*, and at least one enclosure 112*a*, 112*b*, 112*c*, 112*d*. In some embodiments, the enclosures 112 may be brought in by truck and trailer and slid onto the legs 109, base boxes 108, and upper floor portions 130. In other embodiments, each subassembly may be shipped and delivered to the project site in assembled fashion as a unit and set on the cross spreaders 106 as shown. When the legs 109 are pivoted to an upright position, the subassemblies including the enclosures 112 and upper floor portions 130 may form a portion of the drill floor 110. The subassemblies may at least partially surround the base of the A-frame 114 and the base of the mast 116. Generally, the subassemblies may be isolated from hook loading and/or rotary loading. Therefore, in some embodiments, the subassemblies, including legs 109*a*, 109*b*, 109*c*, 109*d*, base boxes 108*a*, 108*b*, 108*c*, 108*d*, upper floor portions 130*a*, 130*b*, 130*c*, 130*d*, and enclosures 112*a*, 112*b*, 112*c*, 112*d* may be relatively light weight.

Figure 11:
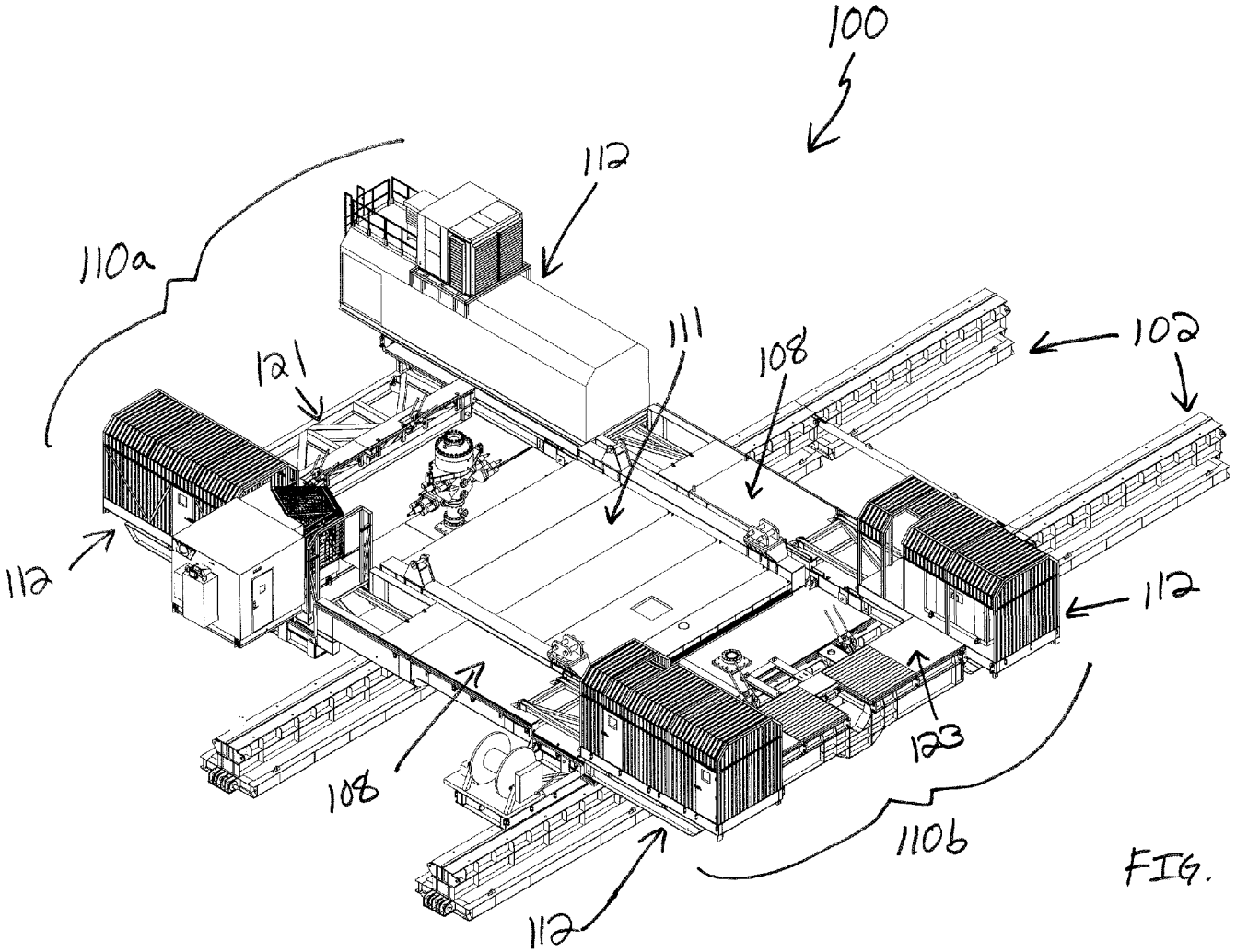
FIG. 11 is a perspective view of the elements of FIG. 10 in addition to a drawworks spreader and setback spreader, according to some embodiments.
Figure 12:
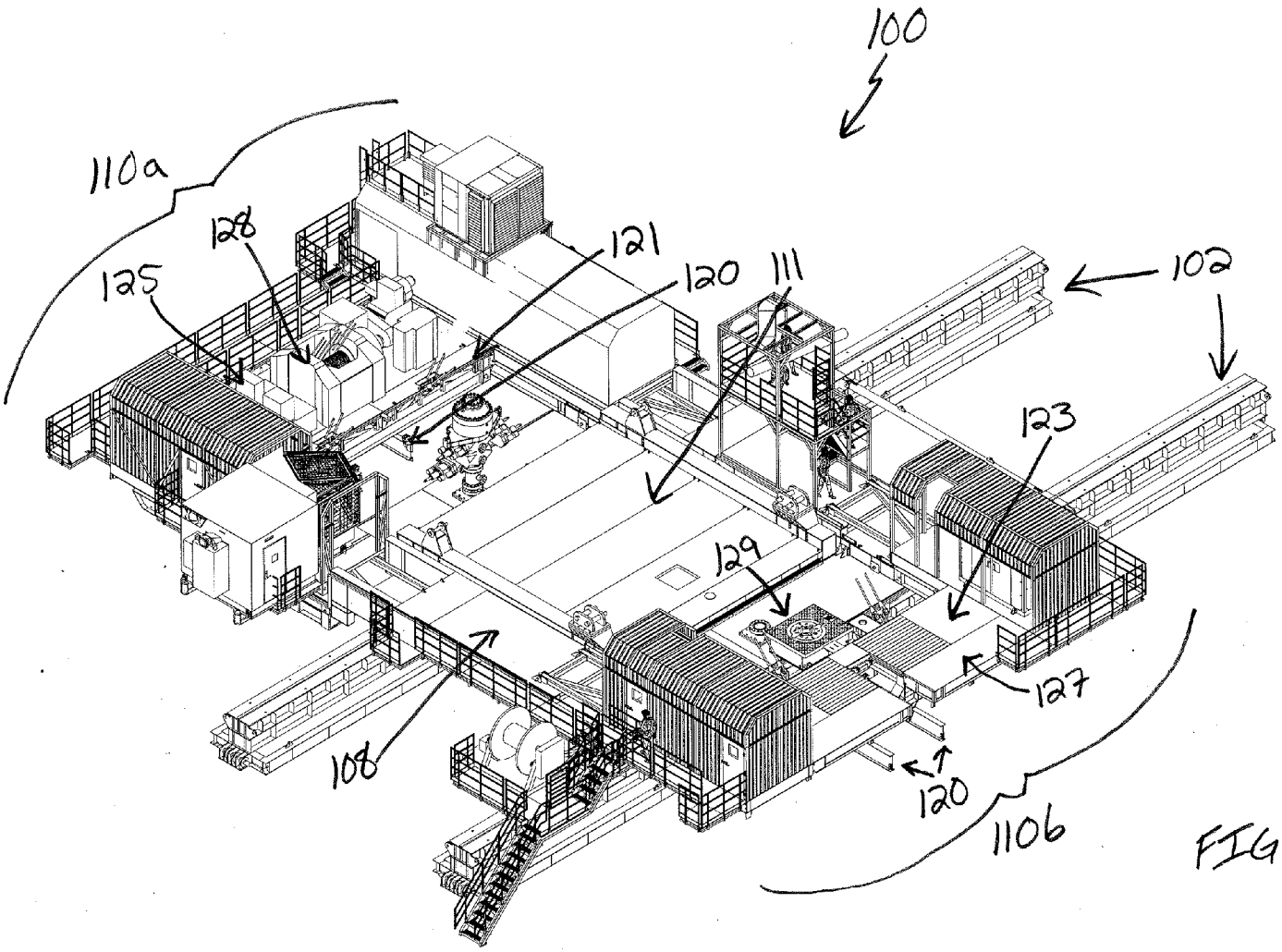
FIG. 12 is a perspective view of the elements of FIG. 11 in addition to a drawworks outer spreader and setback outer spreader, according to some embodiments.

FIG. 11 shows the drawworks spreader 121 spanning between the upper floor portions 130 on a drawworks portion 110*a* of the drill floor 110, and a setback spreader 123 spanning between the upper floor portions 130 on a setback portion 110*b* of the drill floor 110. FIG. 12 further shows the drawworks outer spreader 125 and setback outer spreader 127, which may further expand the drill floor 110. The spreaders 121, 123 and outer spreaders 125, 127 arranged between the subassemblies may each be brought in by truck and trailer and either slid in using a ramp or lifted into place by a crane. Each of them ties the driller side and the off-driller side subassemblies together.

As shown in FIG. 12, a drawworks 128 may be placed on the drawworks spreader 121. The drawworks 128 may be used to raise portions of the drilling rig 100 into place. For example, the drawworks 128 may be used to pivot the legs 109 into an upright position, thus raising the subassemblies including the enclosures 112 and upper floor portions 130. The drawworks 128 may also be used to pivot the A-frame 114 and/or mast 116 into an upright position once they are assembled. Also shown in FIG. 12 is a rotary table 129, installed on the inboard side of the setback spreader 123. Other subassemblies such as walkways and stairs and a flowline handling tower may also be installed on the drill floor 110 while the floor is in the lowered position and the legs 109 are collapsed as shown in FIG. 12. In some embodiments BOP crane rails 120 may be provided on the underside of the drawworks and setback spreaders 121, 123 for use in handling BOPs and other equipment or items below the drill floor 110. When pivoted in an upright position, the crane rails 120 on the drawworks side 110*a* may join with the crane rails on the setback side 110*b*, so as to create a set of substantially continuous crane rails beneath the drill floor 110. The crane rails 120 may be installed when the drill floor 110 is in a lowered position, lifted into place after the drill floor is raised, or the crane rails may be shipped attached to the drill floor.

Figure 13:
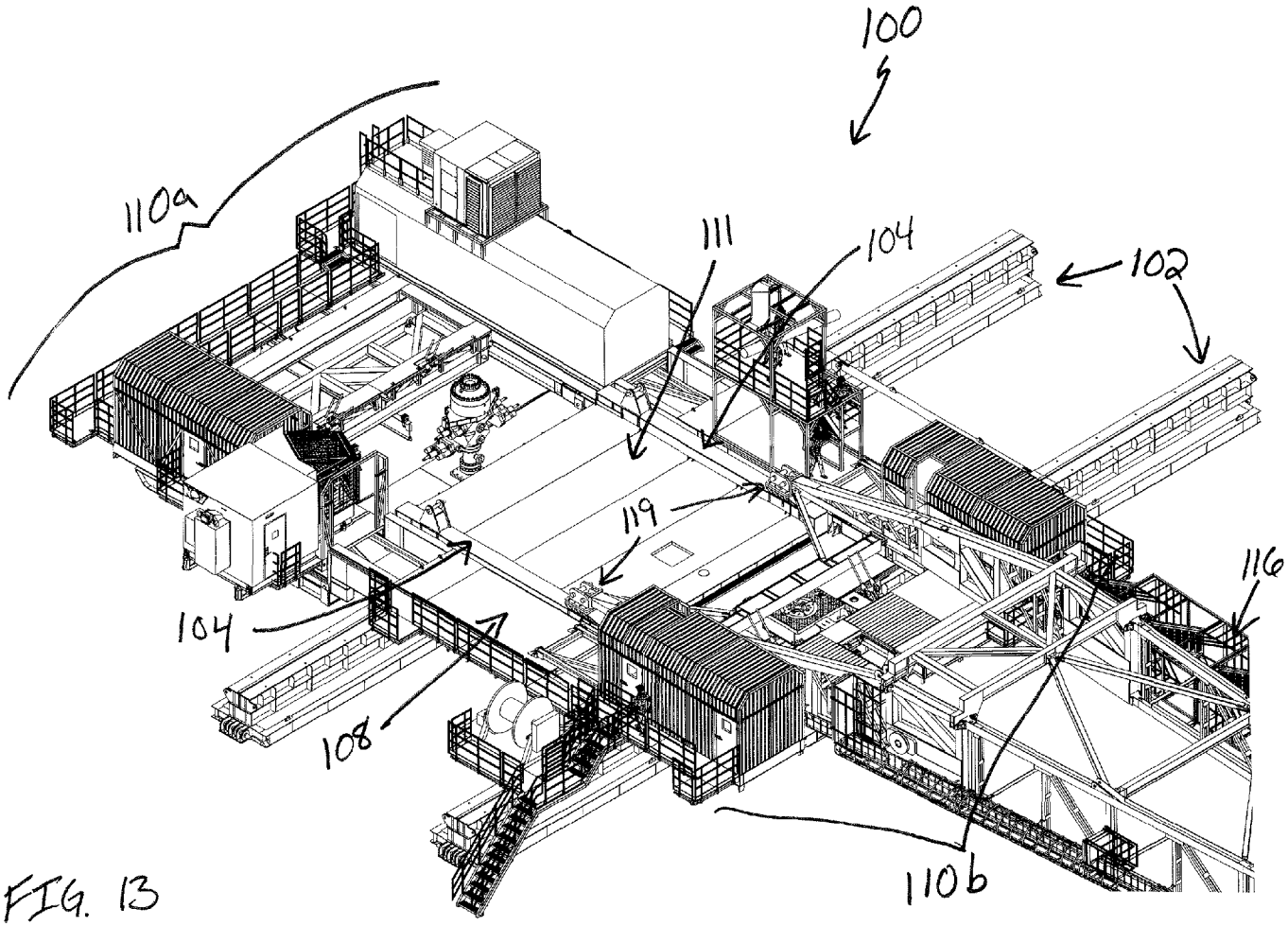
FIG. 13 is a perspective view of the elements of FIG. 12 in addition to a bottom portion of a mast, according to some embodiments.

FIG. 13 shows the bottom section of the mast 116 pivotably secured to the mast shoes 119 on the main beams 104. The mast 116 may include a frame arranged for pivoting in a lay down fashion in a direction generally parallel to the main beams 104 and toward the setback side of the drilling rig 100. The mast 116 may be shipped to the site as multiple pieces and assembled in place or prior to being attached to the mast shoes 119.

Figure 14:
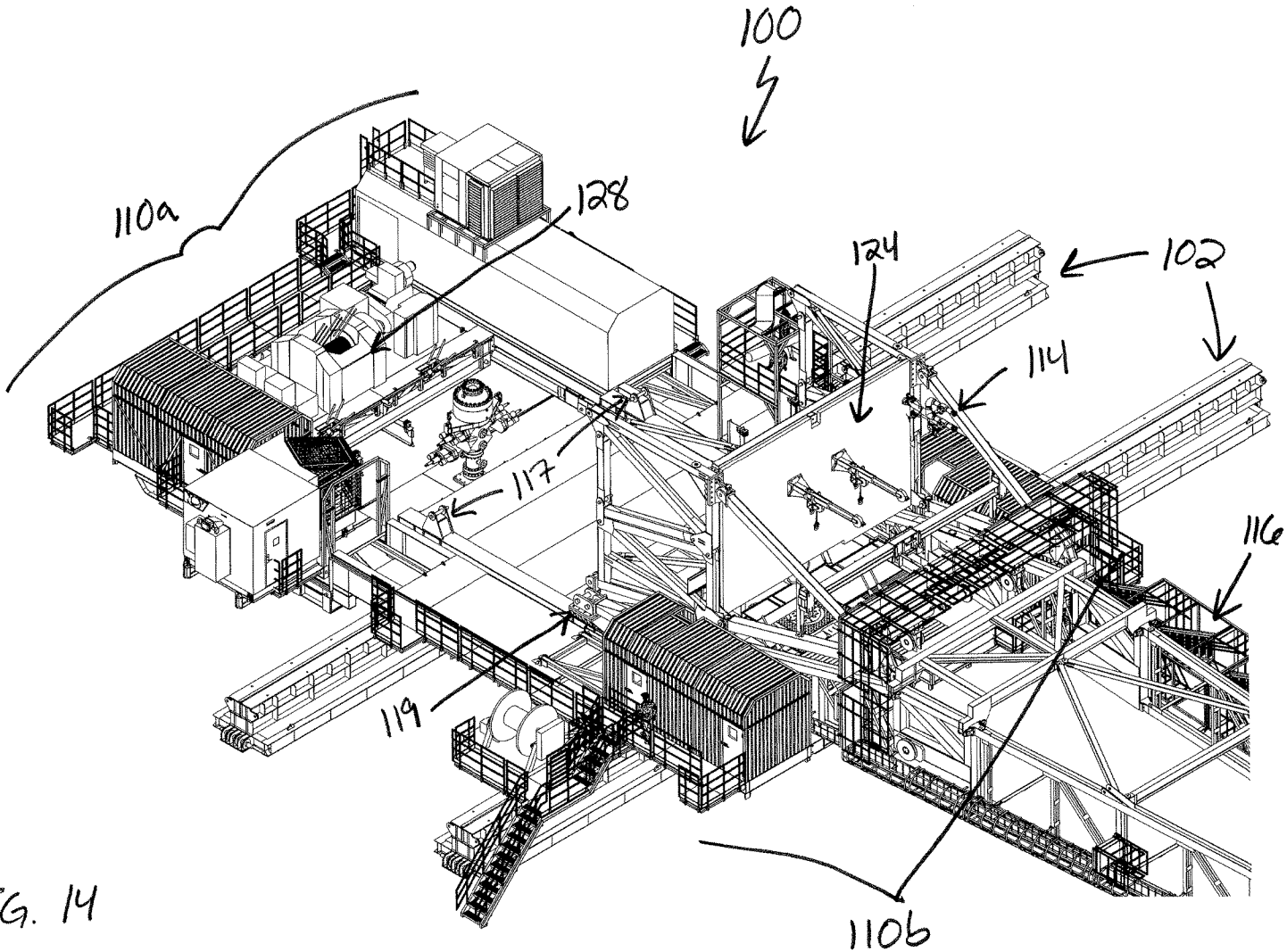
FIG. 14 is a perspective view of the elements of FIG. 13 in addition to an A-frame, according to some embodiments.

FIG. 14 shows the A-frame 114 in place on the rig 100 in laid down fashion. Each of two inboard legs of the A-frame 114 may be secured to and pivotably arranged in the mast shoes 119 together with the bottom of the mast 116 and may be arranged for pivoting in a laydown fashion in a direction generally parallel to the main beams 104 and toward the setback side of the drilling rig 100, such that the inboard legs of the A-frame lie against the legs of the mast 116 in its laid down position. The A-frame 114 may include a central floor 124. In some embodiments, the A-frame 114 may be installed horizontally as shown in FIG. 14, and in some cases may be installed in sections. For example, each leg of the A-frame may be installed in the laying down position separately, followed by the central floor 124 and other components. The A-frame 114 may then be pivoted upward into a vertical position, such that the outboard legs of the frame engage the A-frame shoes 117 on the main beams 104. The upward pivoting of the A-frame may be performed by a crane and/or through the use of the drawworks 128 for example. In other embodiments, as shown for example in FIG. 15, the A-frame 114 may be installed in the vertical or upright position and may not require the pivoting motion. Each piece of the A-frame 114 or the A-frame as substantially one piece may be set into place using low lift cranes in some embodiments.

Figure 15:
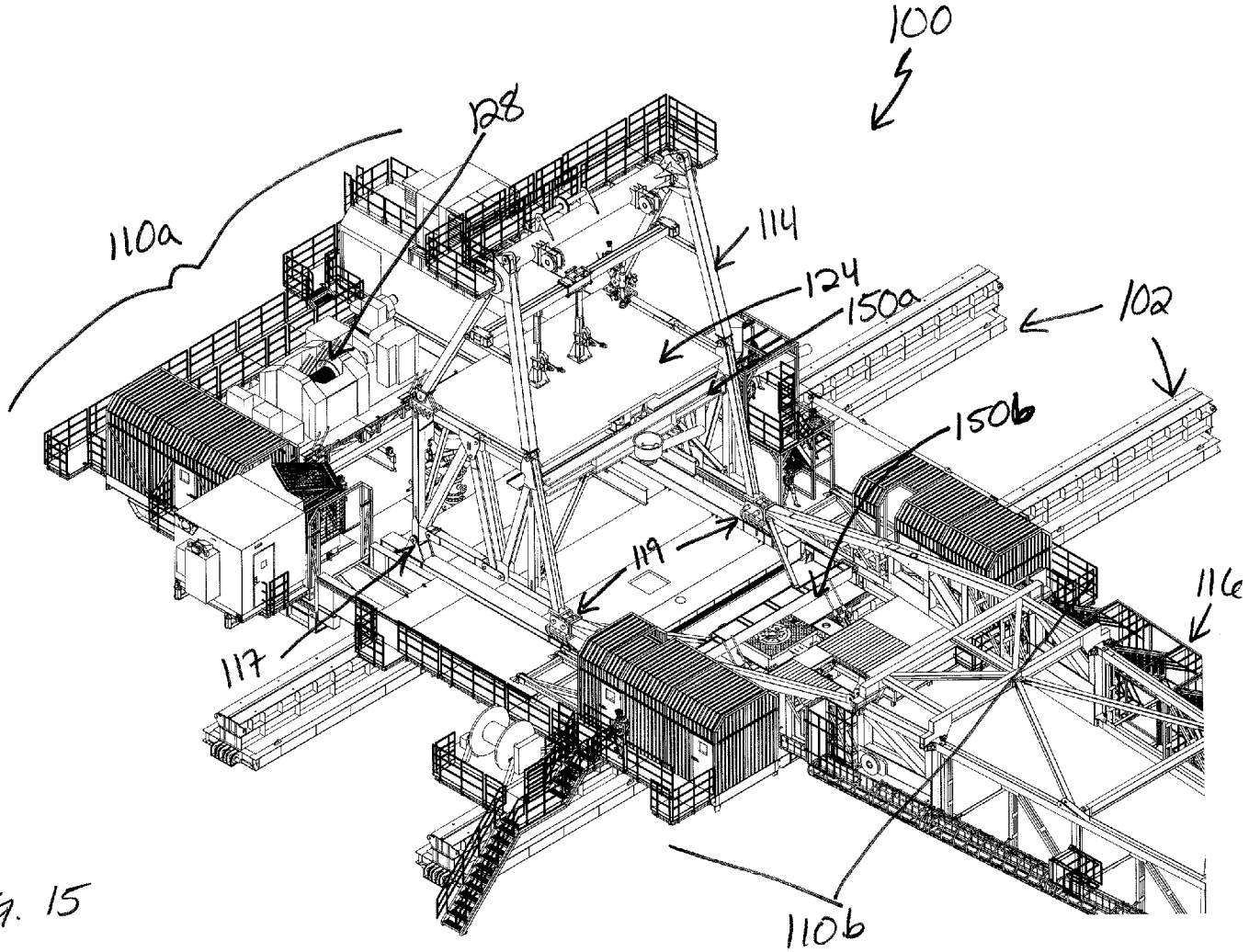
FIG. 15 is a perspective view of an initial step of erecting the drilling rig involving raising the A-frame, according to some embodiments.

With continued reference to FIG. 15, a first rotary table support beam 150*a* may be mounted to the A-frame 114. In some embodiments, a second rotary table support beam 150*b* may be mounted to the mast 116. The first and second rotary table support beams 150*a*, 150*b* may transfer rotary drilling loads to the mast 116 and/or A-frame 114 in some embodiments so as to generally isolate rotary drilling loads from the drilling floor 110 and substructures. In this way, rotary drilling loads may transfer to the main support beams 104 and into the ground.

Figure 16:
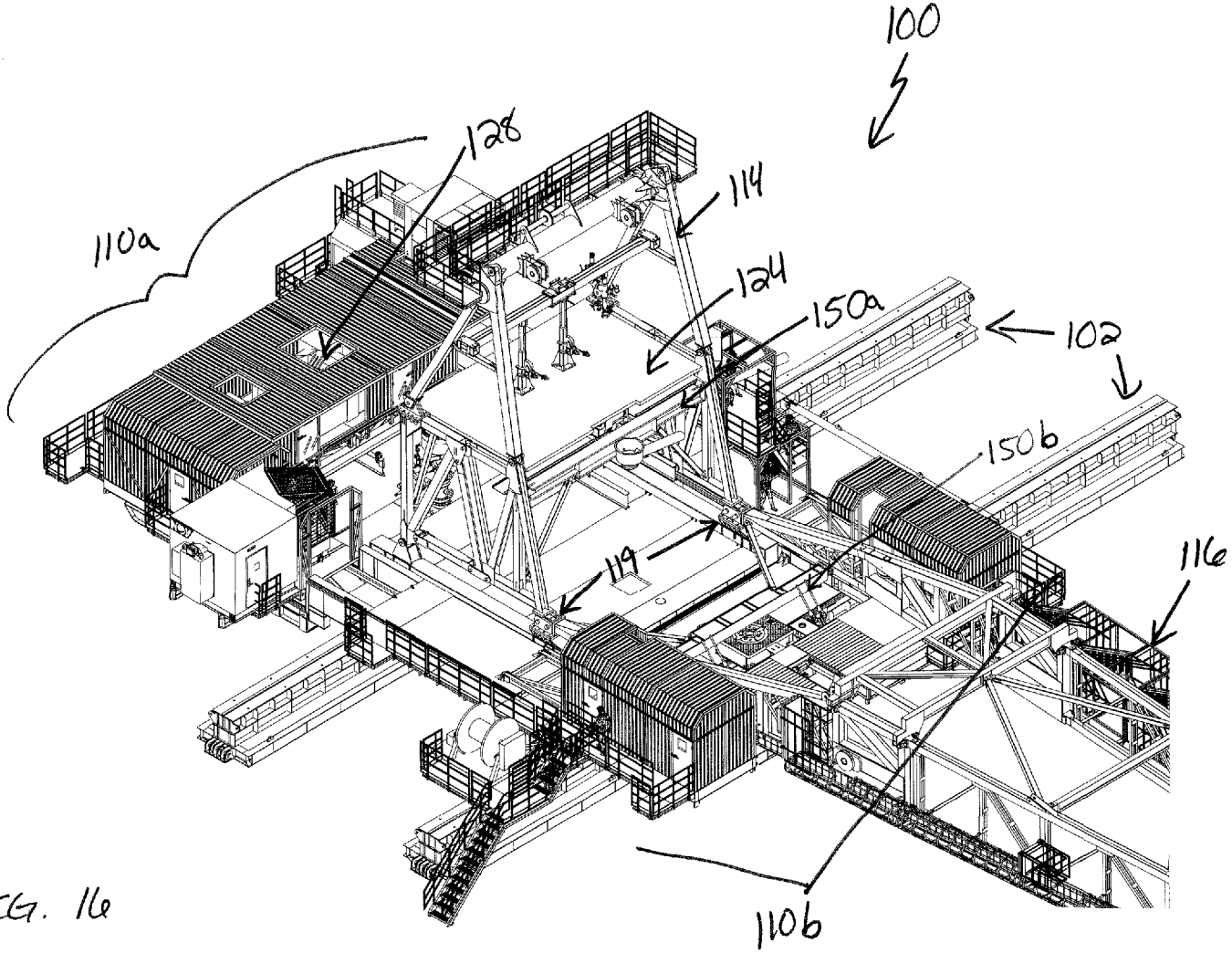
FIG. 16 is a perspective view of the elements of FIG. 15 in addition to winterizing walls on a drawworks portion of the drill floor, according to some embodiments.

FIG. 16 shows installation of walls and a roof around the drawworks 128 and the drawworks portion 110*a* of the drill floor 110. In some embodiments, the walls and roof may be winterizing, for example where the rig 100 will be used in cold climates. This may allow the drawworks compartment to retain heat for heating the drawworks 128.

It is to be appreciated that the rig 100, as shown in FIG. 16, may be in a pre-erected stage. That is, the drilling rig 100 may be fully assembled or nearly fully assembled, but not yet erected to its full height. Once this pre-erected stage is achieved, the use of cranes, including low lift cranes, may no longer be required for installing the drilling rig 100, according to some embodiments. Further, in this pre-erected stage, it is to be appreciated that the overall height of the rig 100 may be relatively low. For example, the rails 102 may be approximately 5 feet tall and aside from the A-frame 114 and mast 116, the structure above the rails 102 may be approximately an additional 7 feet, for example, making the top of the rig structure only 12 feet above the ground. The A-frame 114 structure may be closer to 20-35 feet above the rails 102 when in a laying down or pivoted position, causing the top of the assembled system to be approximately 25-40 feet above the ground, well within the range of a low-lift crane, for example. In embodiments where the A-frame 114 may be installed in an upright position without pivoting, the top of the assembled and pre-erected system may be approximately 40-60 feet above the ground, which may additionally be within the range of a low-lift crane.

Figure 17:
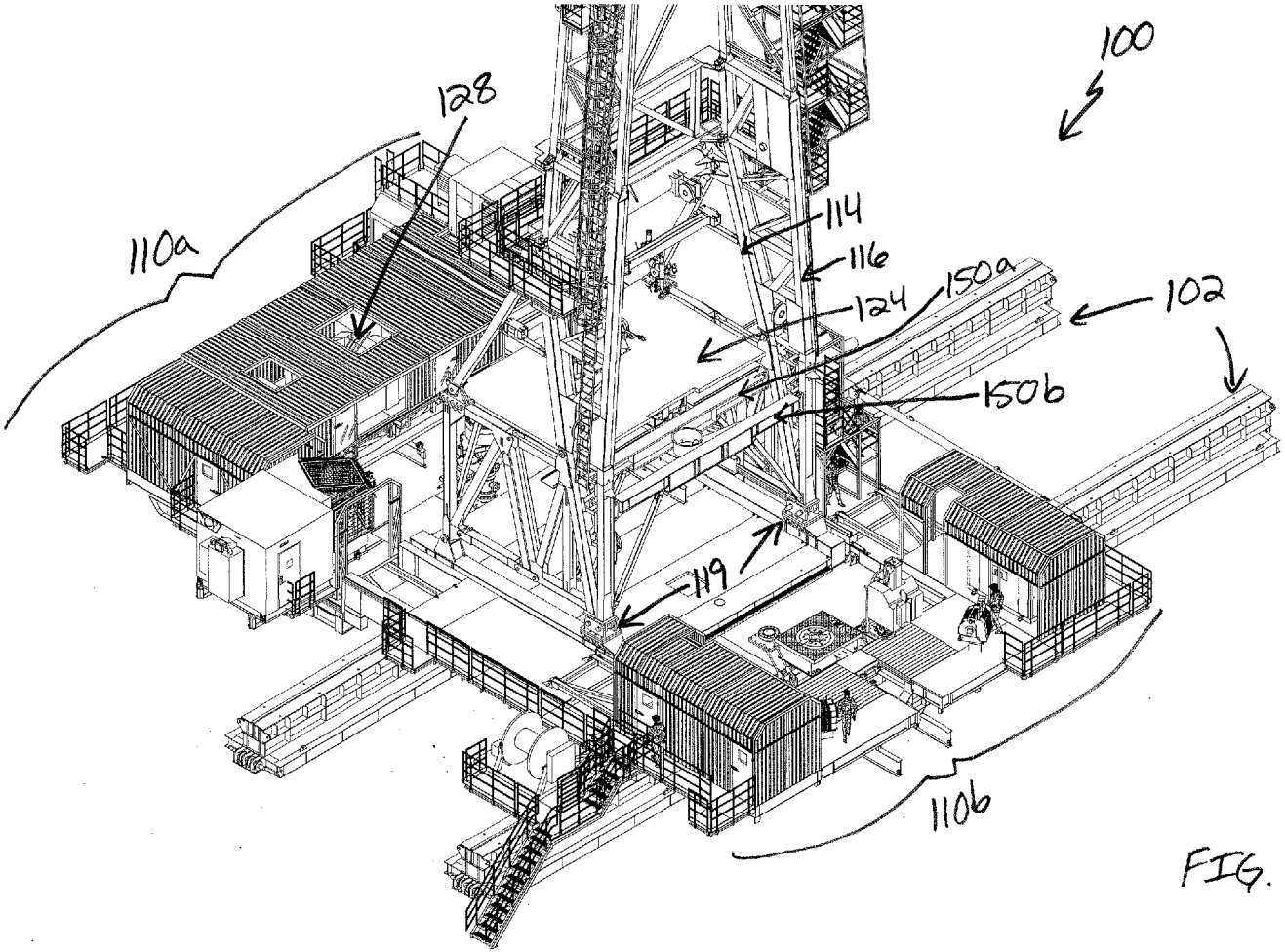
FIG. 17 is a perspective view of another step of erecting the drilling rig involving raising the mast, according to some embodiments.

FIG. 17 shows the mast 116 in in its erected position. The mast 116 may be erected by pulling it in and upward toward the A-frame 114 or well center with the drawworks 128, causing the mast to pivot about its pivotable connections to mast shoes 119. Once erected, the mast 116 may stand adjacent to the inboard legs of the A-frame 114. In some embodiments, the mast 116 may be pivoted into its upright position using only the drawworks 128, which in some cases may be operated with the use of a remote control panel at ground level for example, so that an operator can be clear of the mast while it is raised. Generally, the weight of the rig 100 on the drawworks side may hold the rig in position while the mast 116 is pivoted upward. After the mast 116 is raised, subassemblies such as drill floor winches and an iron roughneck may be installed. In other embodiments, such subassemblies may be installed prior to raising the mast 116.

Figure 18:
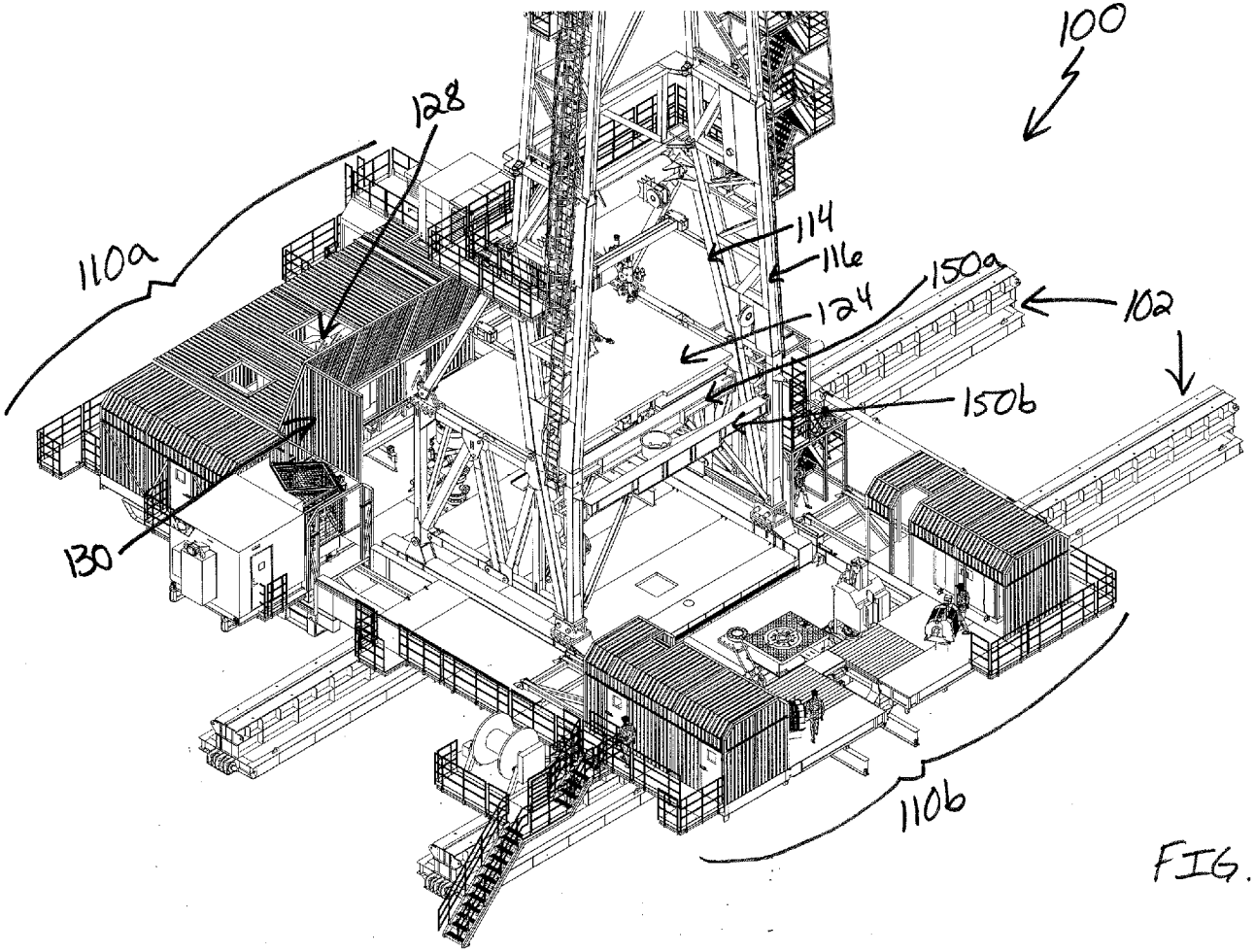
FIG. 18 is a perspective view of the elements of FIG. 17 in addition to windwalls on the drawworks portion of the drill floor, according to some embodiments.
Figure 19:
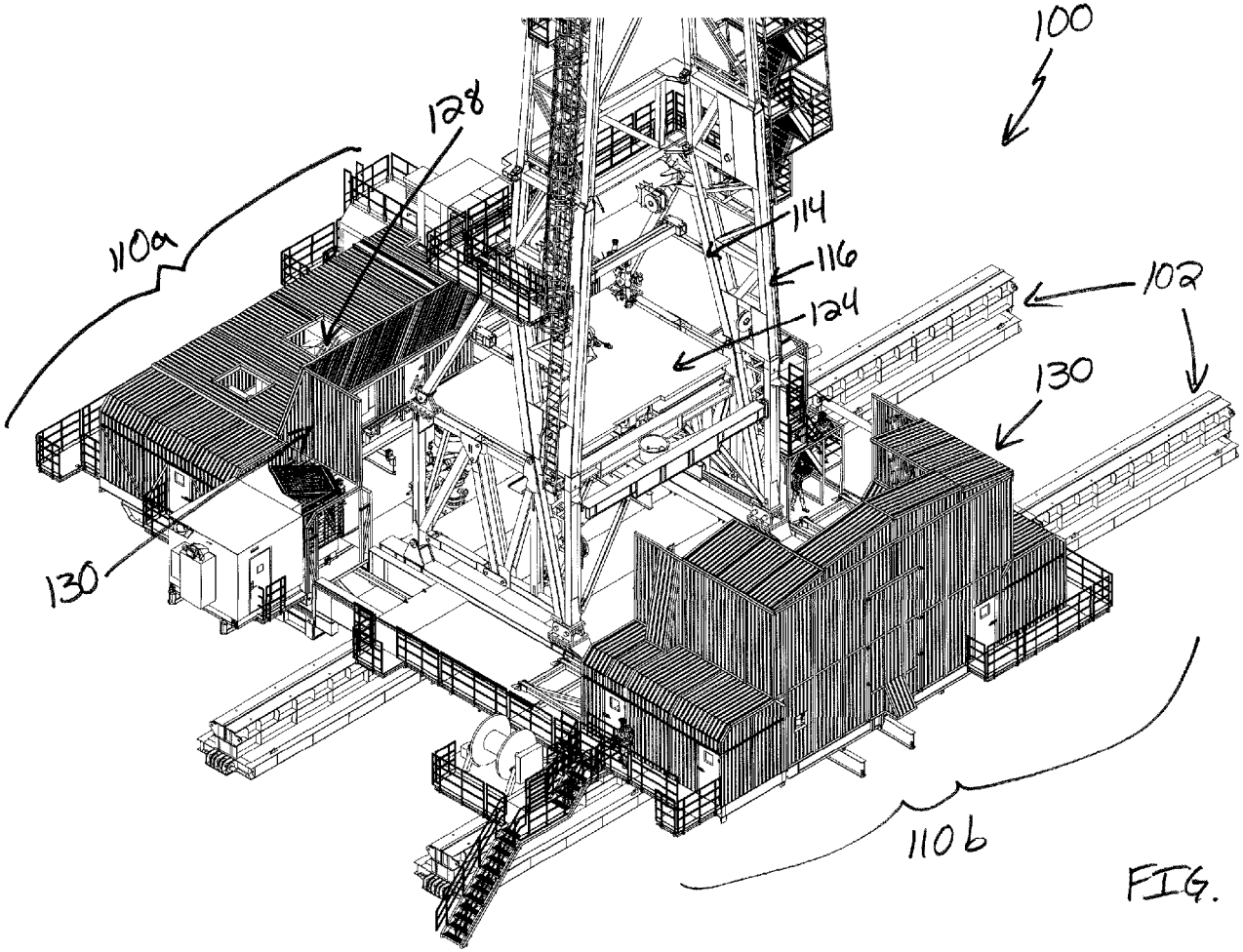
FIG. 19 is a perspective view of the elements of FIG. 18 in addition to windwalls on the setback portion of the drill floor, according to some embodiments.

FIGS. 18 and 19 show the addition of windwalls 130 at the drawworks side 110*a* and setback side 110*b*, respectively, of the drill floor 110. Windwalls 130 may help protect people working on the rig 100 and/or equipment on the rig from environmental elements such as wind, rain, and snow. In some embodiments, the windwalls 130 may be composed of steel or other metals or rigid materials. In other embodiments, the windwalls 130 may be composed of canvas or other materials suitable for the particular environment.

Figure 20:
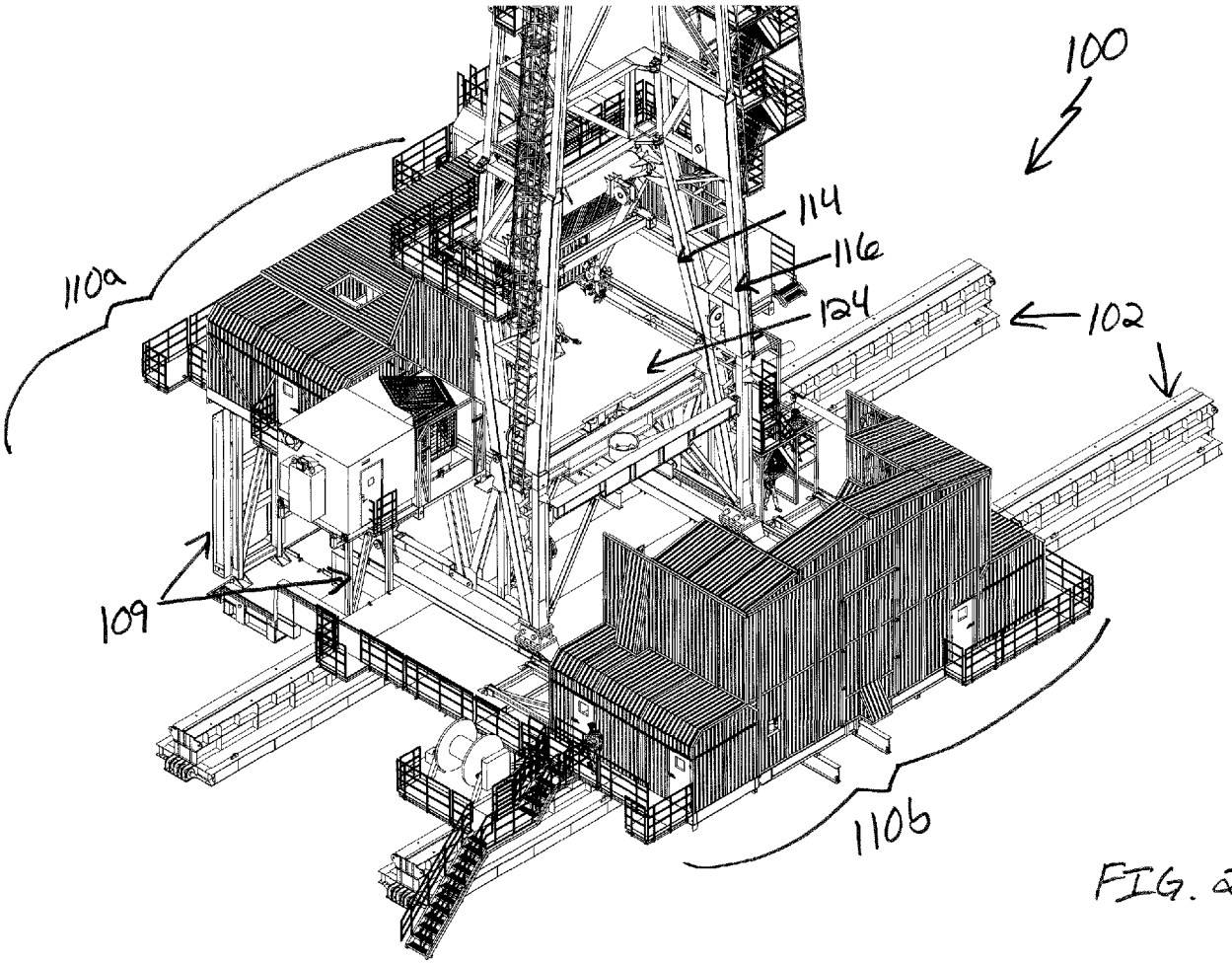
FIG. 20 is a perspective view midway through another step of erecting the drilling rig involving raising the drawworks related portions of the drill floor, according to some embodiments.
Figure 21:
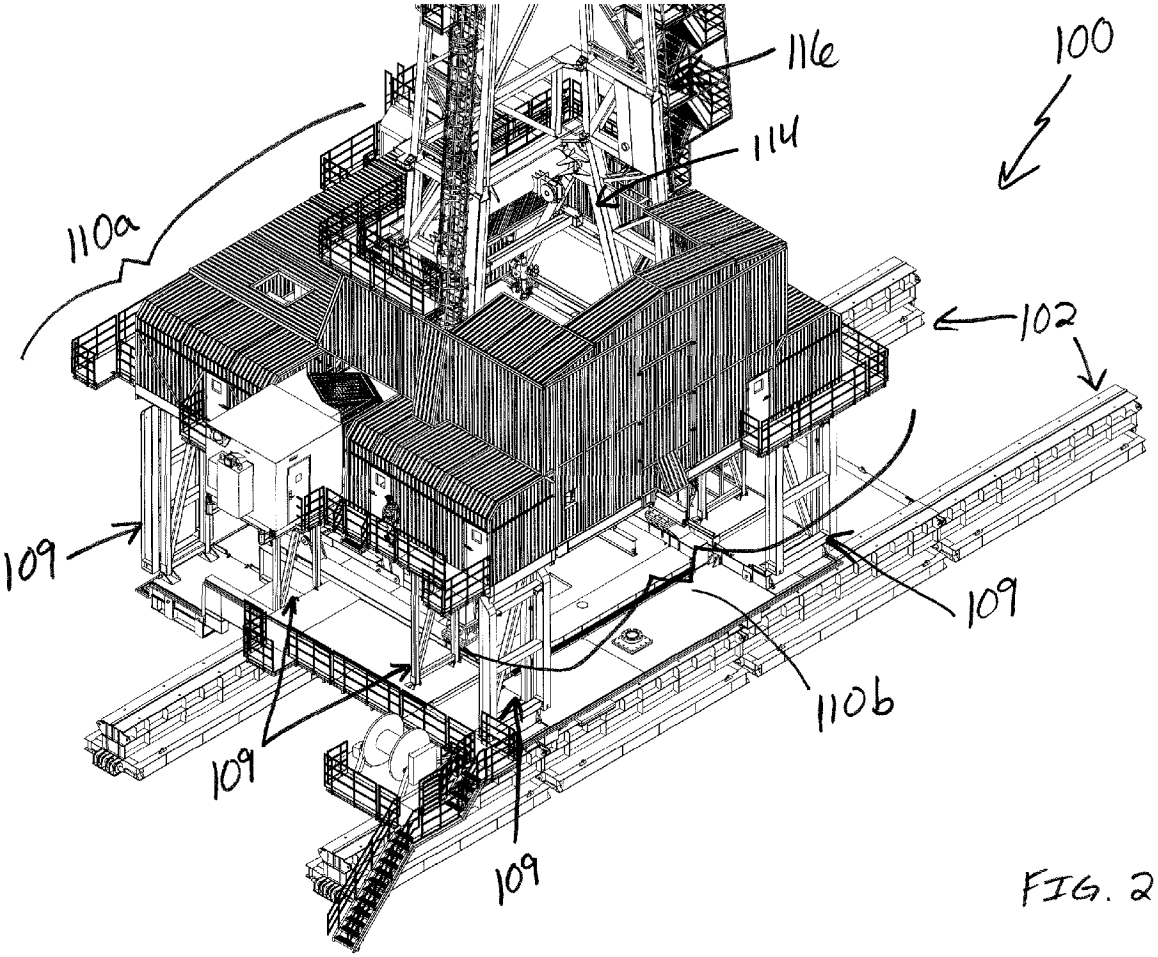
FIG. 21 is a perspective view showing the step of FIG. 20 fully complete, according to some embodiments.

FIGS. 20 and 21 show the erection of the drill floor 110. FIG. 20 shows the erected drawworks side 110*a* of the drill floor 110. The drawworks portion 110*a* of the floor 110 may be erected by pulling the drawworks portion of the floor toward the A-frame 114 or well center, causing the legs 109 to tip upwardly about their pivot connections to both the base boxes 108 and the drill floor. For this operation, the driller side and off-driller side subassemblies on the drawworks end 110*a* may include a connection link and a wire rope and sheave lifting mechanism that may utilize a travelling block and drawworks to lift the entire drawworks end of the drill floor into place. FIG. 21 shows the erected setback side 110*b* of the drill floor 110. As with the drawworks portion 110*a*, the setback portion 110*b* may be raised by pulling the setback portion of the floor toward the A-frame 114 or well center using connection links and wire ropes and sheave lifting mechanisms on the driller side and off-driller side of the setback side 110*b* for example. The lifting operations on each of the drawworks side 110*a* and the setback side 110*b* may be performed from a remote control panel at the ground level in order to keep the operator from having to ride the floor up, for example. Once in an upright position, the drawworks side 110*a* and setback side 110*b* may be pinned bolted or otherwise secured in place to the mast 116 and/or A-frame 114, for example. This connection may be with vertical pins in some embodiments. Use of vertical pins for these connections may allow for transferal of lateral loads between the mast 116 and/or A-frame 114 and the drill floor 110, without or with minimal transferal of vertical loads. This may in turn take advantage of diagonal bracing present in the substructure 101 to stabilize both the substructure and mast 116 against lateral forces such as wind loading for example.

After the drill floor 110 has been raised, other subassemblies such as any miscellaneous drop-in flooring on the drill floor and a control cabin 126 may be installed. A control cabin 126, for example, may be located between the A-frame 114 and mast 116 and may allow for upwardly viewing of the mast 116 such that a driller can have a clear view of the mast and its associated operations. In other embodiments, these and other subassemblies may be installed prior to the erection of the drill floor 110.

Figure 22:
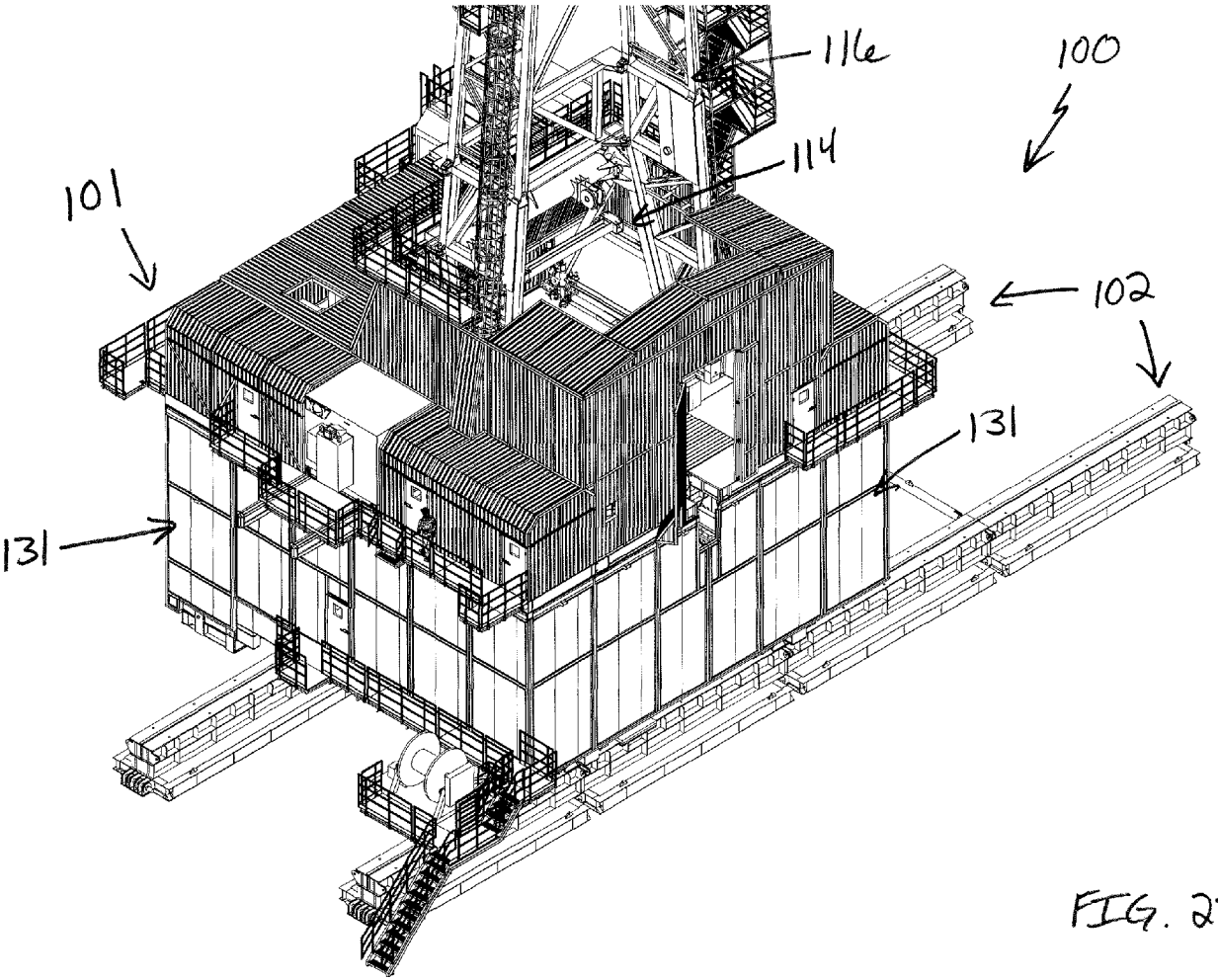
FIG. 22 is a perspective view of the elements of FIG. 20 in addition to cellar windwalls, according to some embodiments.

FIG. 22 shows the addition of cellar windwalls 131 around the cellar portion, beneath the drill floor 110. As with windwalls 130 provided above the drill floor 110, cellar windwalls 131 may help protect people working on the rig 100 and/or equipment on the rig from environmental elements such as wind, rain, and snow. In some embodiments, the cellar windwalls 131 may be composed of steel or other metals or rigid materials. In other embodiments, the cellar windwalls 131 may be composed of canvas or other materials suitable for the particular environment.

Figure 23:
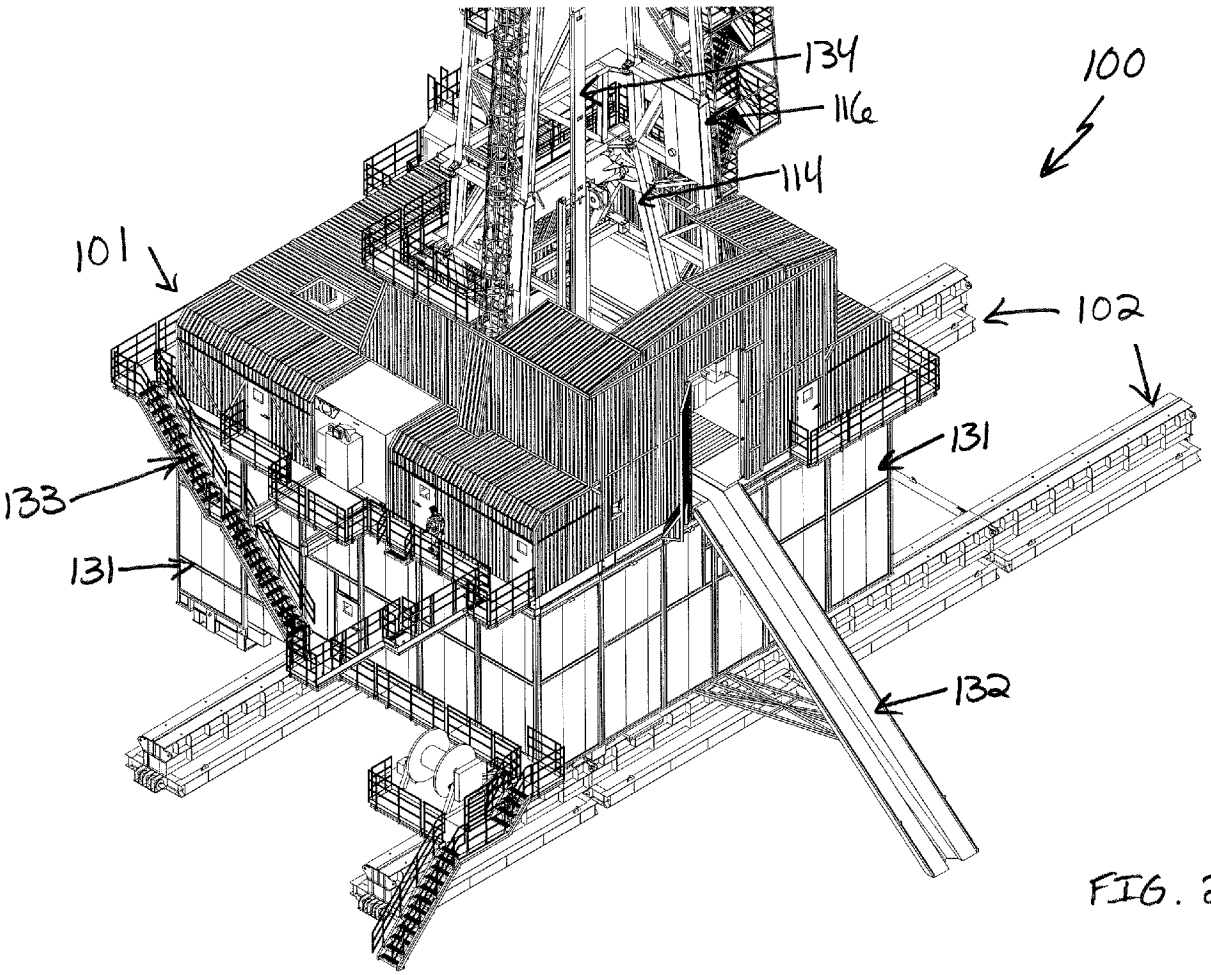
FIG. 23 is a perspective view of the elements of FIG. 22 in addition to some subassemblies, according to some embodiments.

FIG. 23 shows the completed rig 100 in an erected stage. It is to be appreciated that once the drilling rig 100 is in this erected stage, it is generally at its maximum height. In the erected stage, the maximum height of the rig 100 may up to 200 feet above the ground in some embodiments. As shown, such subassemblies as a door ramp with bracing 132 and stairways 133 may be installed after the rig 100 is erected. In other embodiments, such subassemblies may be installed prior to erection of the rig 100. In addition, a torque track 134 and top drive may be installed adjacent to or within the mast 116 and A-frame 114. The torque track may be brought into the rig 100 using the ramp 132 for example.

Once the drilling rig 100 is assembled, drilling may commence. The drilling rig 100 may be periodically moved along the rails 102 in generally either direction. The drilling rig 100 may be moved along the rails between drilling sites. The drilling rig 100 may be disassembled or partially disassembled before being moved and reassembled in some embodiments. After drilling in each location is completed, the drilling rig 100 may be disassembled entirely. Disassembly of the drilling rig 100 may generally include a reversal of the assembly steps. Each component may generally be lowered, removed, or uninstalled in the opposite order in which it was raised, placed, or installed.

Figure 24:
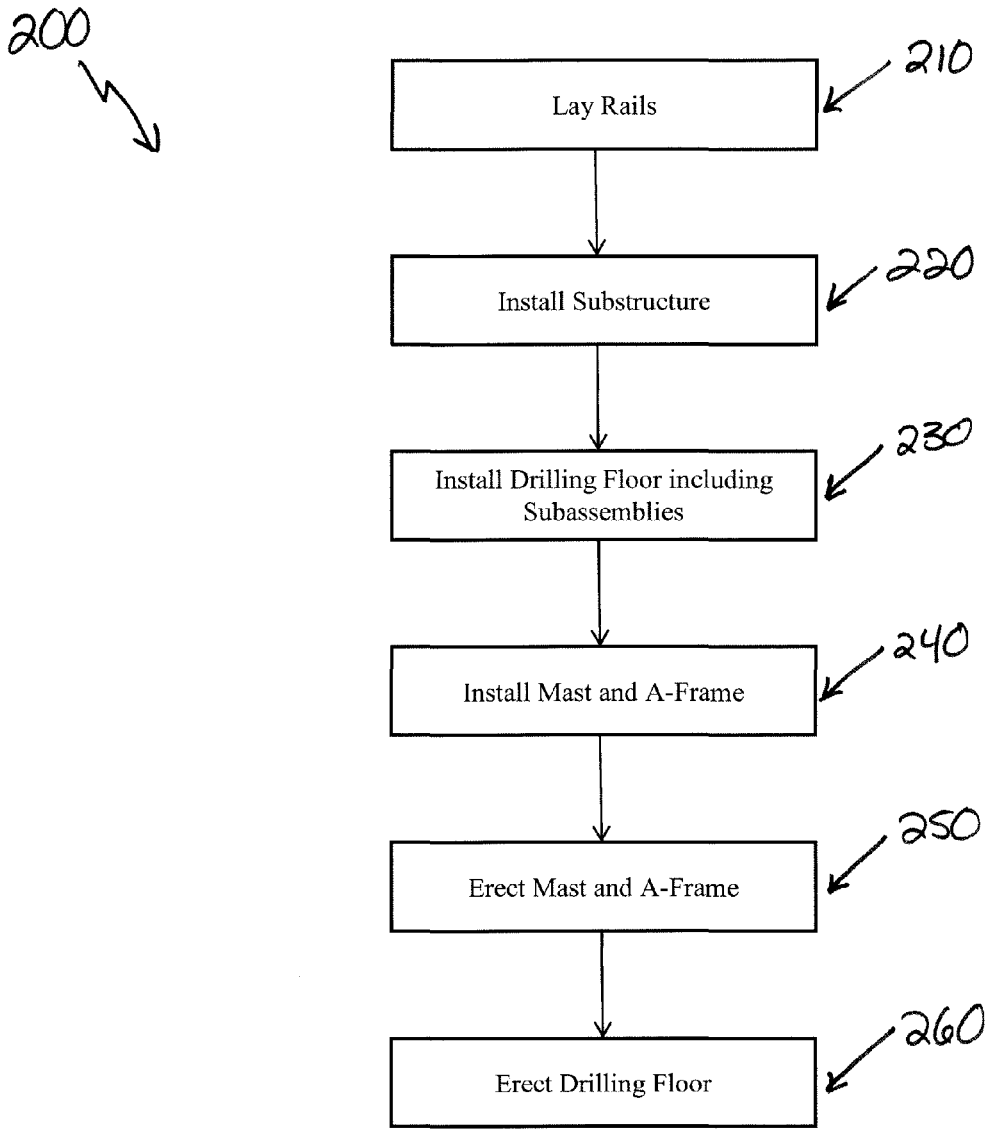
FIG. 24 is a flow diagram of a method of assembling a drilling rig, according to some embodiments.

A drilling rig of the present disclosure may generally be assembled or erected by various methods. Methods of assembly, in some embodiments, may require the use of one or more low lift cranes or other low capacity lifting devices, such as rubber tire cranes, without the need for high lift cranes. Such methods of assembly may be beneficial where high lift cranes may be difficult to acquire such as in remote areas of the world for example. Methods of assembly may also include the use of one or more drawworks assemblies for lifting or otherwise moving portions of the rig. One method 200 for assembling a drilling rig of the present disclosure is shown in FIG. 24. As shown in FIG. 24, a method 200 of the present disclosure may involve several steps. In other embodiments, more or fewer steps than those shown in method 200 may be used to assemble a drilling rig of the present disclosure.

As shown in FIG. 24, the method 200 may include laying rails 210. The rails may include two lines of rail track installed on the ground and designed to allow a drilling rig to move along the rails from one drilling location to another. The rails may therefore be laid so as to connect drilling locations or potential drilling locations. In some embodiments, rails may already be in place, such that a drilling rig of the present disclosure may be assembled on pre-existing rails. In some embodiments, a drilling rig of the present disclosure may be assembled without rail tracks. For example, a drilling rig of the present disclosure may be assembled with walking feet or may be assembled as a stationary rig in other embodiments.

With continued reference to FIG. 24, a method 200 for assembling a drilling rig of the present disclosure may include installing a substructure 220. The substructure may include components at the base of the drilling rig and may be designed to support and distribute the weight of the mast, drill floor, and other subassemblies. The substructure may include such components as support beams, beam spreaders, cross spreaders, a cellar drop-in floor, base boxes, and pivoting legs. In some embodiments, support beams may be laid orthogonal to the rail tracks, so as to evenly distribute weight among the lines of track. Beam spreaders and/or cross spreaders may be installed parallel to the rows of track so as to tie the main beams together, and may be designed to support the drill floor in substantial isolation from the main lifting and mast loads of the drilling rig. Base boxes may be installed parallel to the main beams. Pivoting or collapsible legs may be connected to the base boxes or a different portion of the substructure. The pivoting or collapsible legs may be designed to support the drill floor and/or other subassemblies. The legs may be installed in a collapsed, racked, or laying down position. In some embodiments, two sets of two legs may be installed, such that each set supports a side of the drill floor. In other embodiments, any number of legs or sets of legs may be installed to support the drill floor. The substructure may also include a cellar drop-in floor in some embodiments. A cellar drop-in floor may be installed at the base of the substructure so as to provide a barrier between the substructure and the ground surface. Each of the connections between substructure components may be accomplished with pins, screws, bolts, or other suitable connections. Each of the substructure components may be installed using a low lift crane or may be set or slid into place using other low lift devices, without the need for a high lift crane in some embodiments. Generally, the connections between components may be designed to be reversible such that the drilling rig may be disassembled at a later point in time.

A method 200 for assembling a drilling rig of the present disclosure may include installing a drill floor and subassemblies 230. Installation of the drill floor and subassemblies may take place low to the ground. That is the drill floor and subassemblies may be installed on the pivoting or collapsible legs while they are in a collapsed, racked, or laying down position. In this way, low lift cranes may be used to install the drill floor and subassemblies. According to some embodiments, the drill floor may be installed in two parts. That is, one side of the drill floor may be installed on one side of the rails, and a second side of the drill floor may be installed on the opposing side of the rails, such that when the pivoting or collapsible legs are raised beneath the two sides, the two sides may join together in a raised position. The drill floor may by composed in some embodiments of spreaders and outer spreaders, for example, installed between or on the base boxes. Subassemblies such as enclosures may be installed on the drill floor. The subassemblies may be pre-assembled or may be assembled on site. Other structures such as a drawworks and turntable may be installed on the drill floor while it is in the laying down position.

A method 200 for assembling a drilling rig of the present disclosure may include installing a mast and A-frame 240. An A-frame and mast may each be connected to the support beams or other part of the substructure. The mast may generally be installed in a laying down position, such that the mast lies generally parallel with the support beams and near to the ground. The mast may be installed on pivoting connectors such that it may be pivoted into an upright position. In some embodiments, the A-frame may be installed in a laying down position, similar to the mast such that it may be pivoted into an upright position as well. In other embodiments, the A-frame may be installed in an upright position without the need for a pivoting connection.

A method 200 for assembling a drilling rig of the present disclosure may include erecting the mast and A-frame 250. Each of the A-frame and mast may be pivoted into an upright position, either simultaneously or separately. A low lift crane and/or drawworks may be used to pull the A-frame and mast up into an upright position in some embodiments. Where the A-frame is already installed in an upright position, only the mast need be pivoted upward. Once in an upright position, the A-frame and/or mast may be secured to the support beams or another element of the substructure. The A-frame and mast may additionally or alternatively be secured to one another.

A method 200 for assembling a drilling rig of the present disclosure may include erecting the drill floor 260. The drill floor may be raised in one or more pieces. For example, where the drill floor is generally separated into two sides, each side supported by a pair of pivoting legs, each side may be raised individually. This may be accomplished by pulling each side inward toward the center of the rig and upward, allowing the legs to pivot, and bringing the drill floor into an upright position. As the drill floor is raised, subassemblies connected to the drill floor, such as enclosures, may be raised as well. The drill floor may generally wrap around and/or join with the A-frame and mast. Once all portions of the drill floor are in an upright position, they may be secured to one another and/or the A-frame or mast.

In addition to the steps 210-260, the method 200 for assembling a drilling rig of the present disclosure may include other steps. For example, additional subassemblies or other components may be installed on the rig before or after the mast and/or drill floor are erected. Windwalls, for example may be installed on the drill floor and/or substructure. The method 200 may include installation of such components as ramps, stairs, and walkways for workers. Crane rails may be installed beneath the drill floor to allow for a BOP to be put in place, for example. Other steps may be included in the assembly in other embodiments. Likewise, in some embodiments, some steps of the method 200 may be omitted from the assembly or substituted for other steps. Other methods of assembling a drilling rig of the present disclosure may be used as well.

Figure 25:
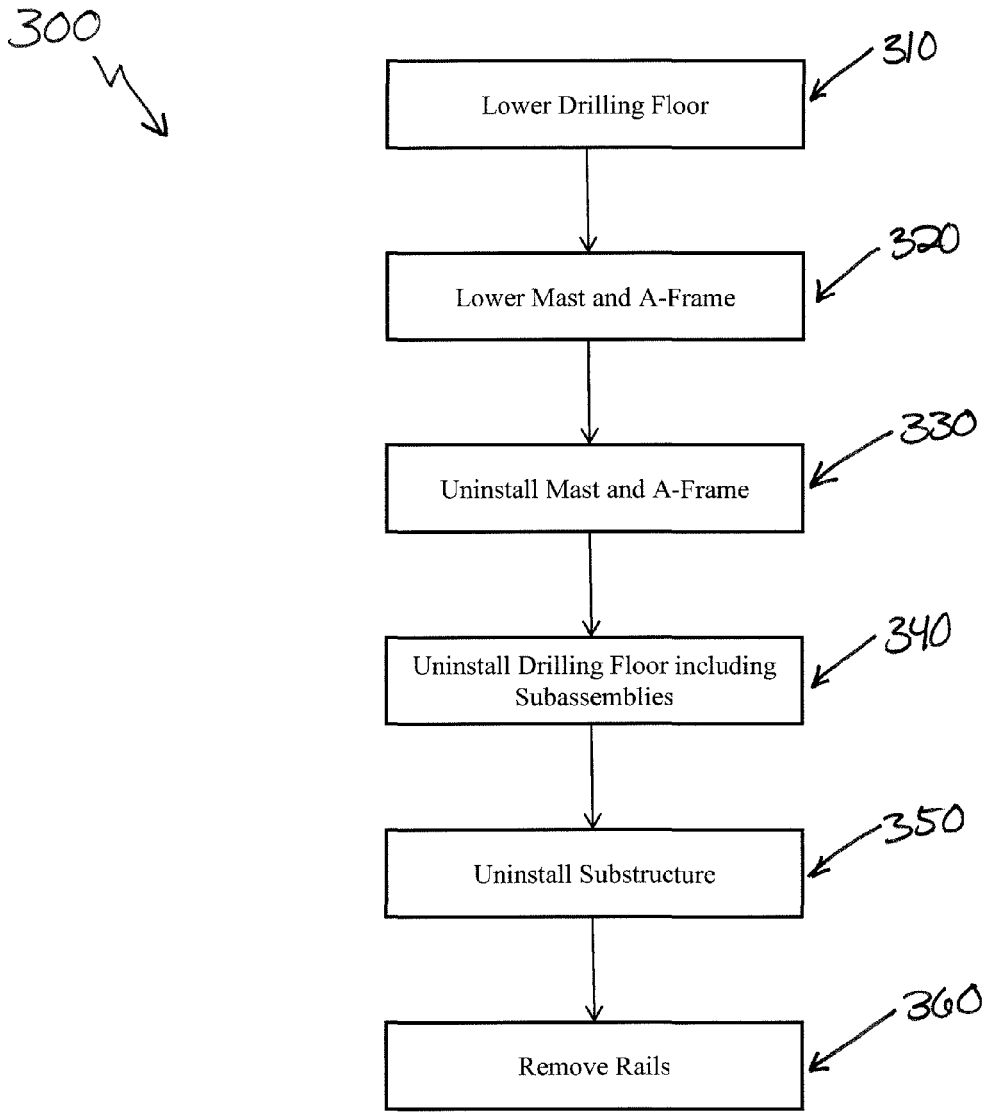
FIG. 25 is a flow diagram of a method of disassembling a drilling rig, according to some embodiments.

A drilling rig of the present disclosure may generally be disassembled by various methods. One method 300 for disassembling a drilling rig of the present disclosure is shown in FIG. 25. As may be appreciated, a drilling rig of the present disclosure may generally be disassembled in an opposite manner from which is was assembled. That is, Where assembly included the steps of erecting the drill floor and mast for example, disassembly may include the steps of lowering the drill floor and mast. As shown in FIG. 25, one method 300 for disassembly may include such steps as lowering the drill floor 310, lowering the mast and A-frame 320, uninstalling the mast and A-frame 330, uninstalling the drill floor including subassemblies 340, uninstalling the substructure 350, and removing the rails 360. In addition to the steps 310-360, the method 300 for disassembling a drilling rig of the present disclosure may include other steps. For example, disassembly may include the removal of other subassemblies or components installed during assembly. Likewise, in some embodiments, some steps of the method 300 may be omitted from the disassembly or substituted for other steps. Other methods of disassembling a drilling rig of the present disclosure may be used as well.

Various embodiments of the present disclosure may be described herein with reference to flowchart illustrations and/or block diagrams of methods, apparatus (systems), and computer program products. It is understood that each block of the flowchart illustrations and/or block diagrams, and/or combinations of blocks in the flowchart illustrations and/or block diagrams, can be implemented by computer-executable program code portions. These computer-executable program code portions may be provided to a processor of a general purpose computer, special purpose computer, or other programmable data processing apparatus to produce a particular machine, such that the code portions, which execute via the processor of the computer or other programmable data processing apparatus, create mechanisms for implementing the functions/acts specified in the flowchart and/or block diagram block or blocks. Alternatively, computer program implemented steps or acts may be combined with operator or human implemented steps or acts in order to carry out an embodiment of the invention.

Additionally, although a flowchart or block diagram may illustrate a method as comprising sequential steps or a process as having a particular order of operations, many of the steps or operations in the flowchart(s) or block diagram(s) illustrated herein can be performed in parallel or concurrently, and the flowchart(s) or block diagram(s) should be read in the context of the various embodiments of the present disclosure. In addition, the order of the method steps or process operations illustrated in a flowchart or block diagram may be rearranged for some embodiments. Similarly, a method or process illustrated in a flow chart or block diagram could have additional steps or operations not included therein or fewer steps or operations than those shown. Moreover, a method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A drilling rig, comprising:

a pair of main beams supportable by a pair of rails;

a substructure comprising:

a plurality of pivoting legs;

a drill floor comprising a plurality of spreaders pivotably supported by the plurality of pivoting legs; and a plurality of drill floor subassemblies supported by the plurality of spreaders;

an A-frame secured to the main beams; and a mast pivotably secured to the main beams and configured to lay down in a pre-erected stage;

wherein the plurality of pivoting legs supporting the plurality of spreaders are configured to lay down in a pre-erected stage.

2. The drilling rig of claim 1, wherein the plurality of drill floor subassemblies comprise an enclosure.

3. The drilling rig of claim 1, wherein the substructure further comprises a pair of base boxes.

4. The drilling rig of claim 3, wherein the plurality of pivoting legs are pivotably connected to the pair of base boxes.

5. The drilling rig of claim 1, further comprising a cellar drop-in floor.

6. The drilling rig of claim 1, wherein in a pre-erected stage, the height of the rig is between 40-60 feet above the ground surface.

7. The drilling rig of claim 1, wherein the A-frame is pivotably secured to the main beams and configured to lay down in a pre-erected stage.

8. The drilling rig of claim 7, wherein in a pre-erected stage, the height of the rig is between 25-40 feet above the ground surface.

9. The drilling rig of claim 1, further comprising a pair of rotary table support beams.

10. The drilling rig of claim 1, wherein vertical loads of the mast and A-frame are isolated from the vertical loads of the drill floor and drill floor subassemblies.

11. A drilling rig, comprising:
an A-frame portion;
a mast portion; and
a substructure portion comprising:
a plurality of drill floor subassemblies; and
means for pivotably erecting the subassemblies,
wherein the A-frame portion and mast portion are secured to a pair of main beams supportable by a pair of rails, and
wherein the mast portion is pivotably secured to the pair of main beams and is configured to lay down in a pre-erected stage.

12. The drilling rig of claim 11, wherein the A-frame portion is pivotably secured to the pair of main beams and is configured to lay down in a pre-erected stage.

13. A method for assembling a drilling rig, comprising:
installing a pair of main beams on a pair of rails;
installing a plurality of pivoting legs in a laying down position, and configured to pivot into an upright position;
installing a drill floor pivotably supported on the pivoting legs;
installing an A-frame;
installing a mast in a laying down position, and configured to pivot into an upright position;
erecting the mast by pivoting it into an upright position; and
erecting the drill floor by pivoting the pivoting legs into an upright position.

14. The method of claim 13, wherein erecting the mast is completing using a drawworks.

15. The method of claim 13, wherein erecting the drill floor is completed using a drawworks.

16. The method of claim 13, wherein in the laying down position, the height of the rig is between 40-60 feet above the ground surface.

17. The method of claim 13, wherein the A-frame is installed in a laying down position and configured to pivot into an upright position.

18. The method of claim 17, wherein in the laying down position, the height of the rig is between 25-40 feet above the ground surface.

19. The drilling rig of claim 11, wherein the means for pivotably erecting the subassemblies includes means for pivotably erecting one or a subset of the plurality of subassemblies.

20. The drilling rig of claim 19, wherein the plurality of drill floor subassemblies are configured to collectively form a portion of a drill floor in an erected position.

21. The drilling rig of claim 11, wherein the plurality of drill floor subassemblies comprises a driller side subassembly and an off-driller side subassembly.

22. The drilling rig of claim 21, further comprising a spreader extending between the driller side subassembly and an off-driller side subassembly.

23. The drilling rig of claim 22, wherein the spreader is connected to the driller side subassembly and an off-driller side subassembly such that the spreader is erected simultaneously with the driller side subassembly and the off-driller side subassembly.

24. The drilling rig of claim 23, wherein the spreader is a drawworks spreader comprising a drawworks configured to pull the drawworks spreader, the driller side subassembly, and the off-driller side subassembly into an erected position.

* * * * *